US008449008B2

(12) United States Patent
Apps et al.

(10) Patent No.: US 8,449,008 B2
(45) **Date of Patent: *May 28, 2013**

(54) DUMPSTER

(75) Inventors: William P. Apps, Alpharetta, GA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/364,788

(22) Filed: Feb. 2, 2012

(65) Prior Publication Data

US 2012/0132662 A1 May 31, 2012

Related U.S. Application Data

(63) Continuation of application No. 12/355,619, filed on Jan. 16, 2009, now Pat. No. 8,141,921.

(60) Provisional application No. 61/021,404, filed on Jan. 16, 2008.

(51) Int. Cl.
*B65F 1/14* (2006.01)

(52) U.S. Cl.
USPC ..... 294/68.2; 294/68.26; 220/908

(58) Field of Classification Search
USPC ..... 294/68.2, 68.26; 220/1.5, 908
See application file for complete search history.

(56) References Cited

U.S. PATENT DOCUMENTS

| | | | | |
|---|---|---|---|---|
| 3,669,485 | A | 6/1972 | Stihler | |
| 4,550,849 | A | 11/1985 | Adsit | |
| 5,183,180 | A | 2/1993 | Hawkins et al. | |
| 5,330,071 | A | 7/1994 | Parker | |
| 6,632,064 | B1 | 10/2003 | Walker et al. | |
| 7,198,166 | B2 | 4/2007 | Sholinder | |
| 7,237,689 | B2 | 7/2007 | Maggio, Sr. et al. | |
| 7,762,565 | B2 | 7/2010 | Hatamian et al. | |
| 8,141,921 | B2 * | 3/2012 | Apps et al. | 294/68.2 |
| 2001/0027826 | A1 | 10/2001 | Carpenter | |

* cited by examiner

*Primary Examiner* — Dean Kramer
(74) *Attorney, Agent, or Firm* — Carlson, Gaskey & Olds

(57) ABSTRACT

Several embodiments of plastic dumpsters with improved strength and durability are disclosed. In one embodiment, gussets connect pockets to bevel walls, connecting the side walls to front and rear walls of the dumpster. The bevel walls are stronger than the side walls of the dumpster. Other embodiments disclose gussets integral with front and rear walls of the dumpster for improved strength. Other embodiments disclose removable, separately formed sleeves that are secured to the sides of the dumpster to form pockets for receiving the forks of a truck.

22 Claims, 27 Drawing Sheets

DUMPSTER

This application is a continuation of U.S. patent application Ser. No. 12/355,619, filed on Jan. 16, 2009, now U.S. Pat. No 8,141,921 which claims priority to U.S. Provisional Application Serial No. 61/021,404, filed Jan. 16, 2008.

BACKGROUND

The present invention relates generally to large containers, in particular dumpsters that can be lifted and dumped by forks of a refuse or recycling truck. Traditionally, these dumpsters were constructed of metal with metal pockets welded to side walls for receiving the forks of the truck. A more recent dumpster is constructed entirely of plastic. The pockets on the side walls are integrally molded with the walls of the dumpster in a rotomolding process.

SUMMARY

The present invention provides several embodiments of plastic dumpsters with improved strength and durability.

In one embodiment, gussets connect pockets to bevel walls, connecting the side walls to front and rear walls of the dumpster. The bevel walls are stronger than the side walls of the dumpster. Other embodiments disclose gussets integral with front and rear walls of the dumpster for improved strength. Other embodiments disclose removable, separately formed sleeves that are secured to the sides of the dumpster to form pockets for receiving the forks of a truck.

DETAILED DESCRIPTION OF PREFERRED EMBODIMENTS

Figure 1:
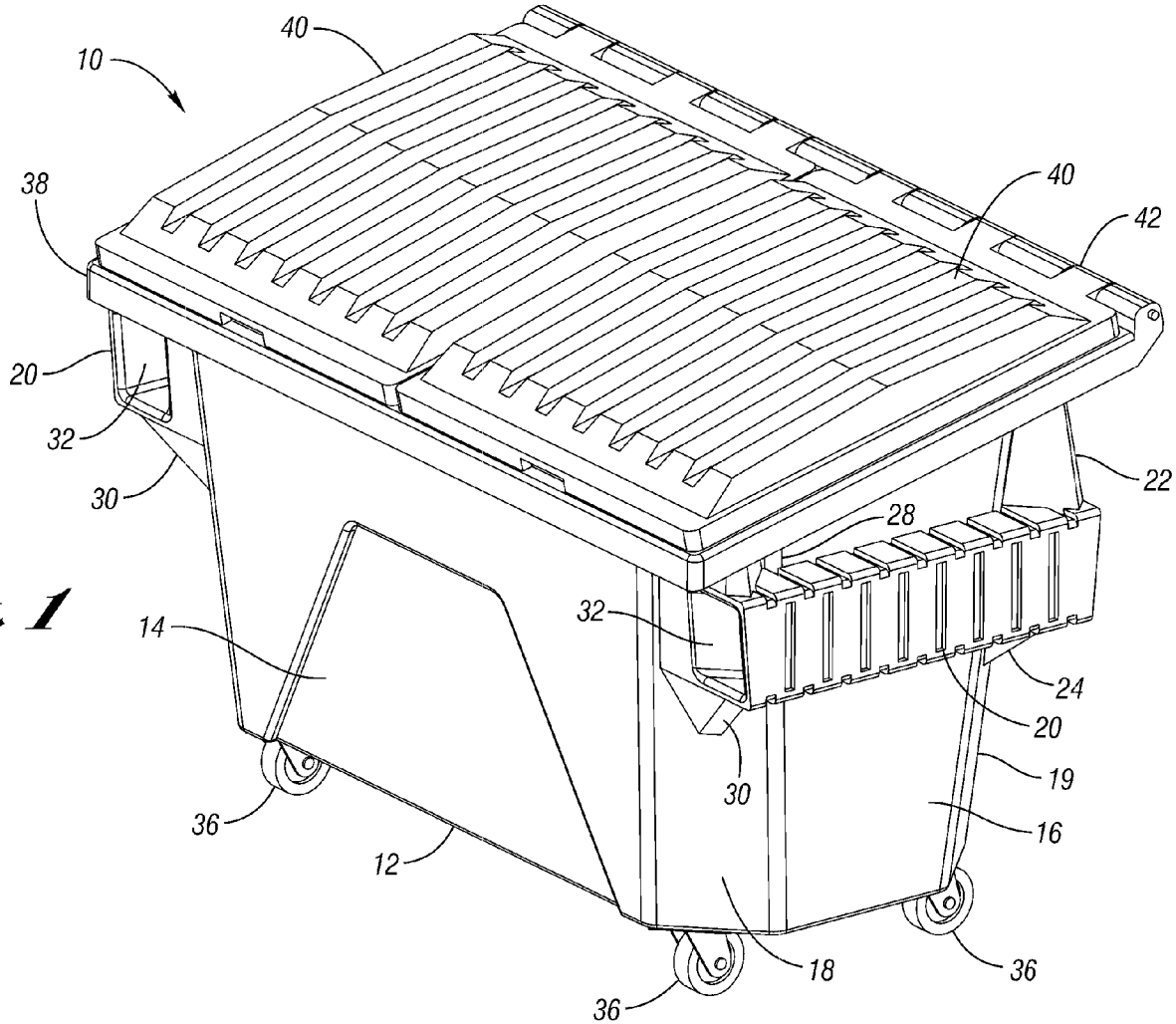
FIG. 1 is a perspective view of a dumpster according to a first embodiment.

A dumpster 10 according to a first embodiment of the present invention is shown in FIG. 1. The dumpster 10 includes a base wall 12, front wall 14, side walls 16 and a rear wall 46 (FIGS. 3 and 4) defining an interior of the dumpster 10. Between the front wall 14 and side walls 16 are front bevel walls 18. Between the rear wall 46 and side walls 16 are rear bevel walls 19.

The dumpster 10 includes pockets 20 adjacent each side wall 16. An upper gusset 22 above the pocket and a lower gusset 24 below the pocket 20 are integral with the rear bevel wall 19. An upper gusset 28 above the pocket and a lower gusset 30 below the pocket 20 are integral with the front bevel wall 18. The gussets 22, 24, 28, 30 support and reinforce the pockets 20. The pockets 20 include openings 32 for receiving the fork of a truck for lifting and dumping the dumpster 10.

By virtue of the connected perpendicular walls, the joints between the side walls and the front or rear wall of a container (usually the "corners," and here including the bevel walls) are inherently stronger and more rigid than the walls themselves. By positioning the gussets 22, 24, 28, 30 in the corners (i.e. the bevel walls 18, 19) in the dumpster 10, the connection of the pockets 20 to the dumpster 20 is stronger and more rigid.

The dumpster 10 may include optional casters 36 on the base 12.

As shown, the upper edges of the side walls 16 are angled downwardly toward the front wall 14. The upper edges of the walls 14, 16, 46 include a lip 38 that reinforces the walls and accommodates a hinge 42 connecting a pair of lids 40 to the rear wall 46.

Figure 2:
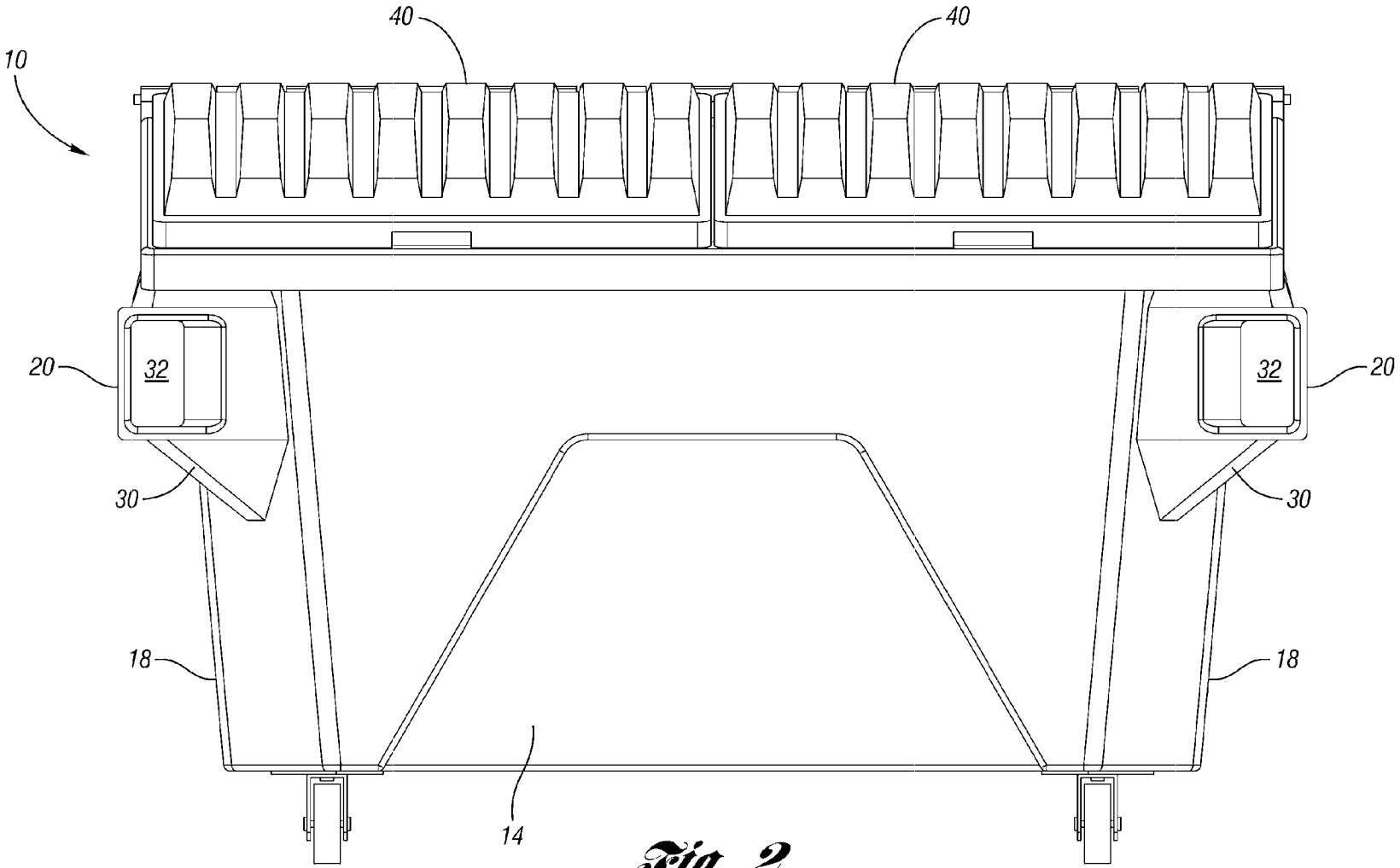
FIG. 2 is a front view of the dumpster of FIG. 1.
Figure 3:
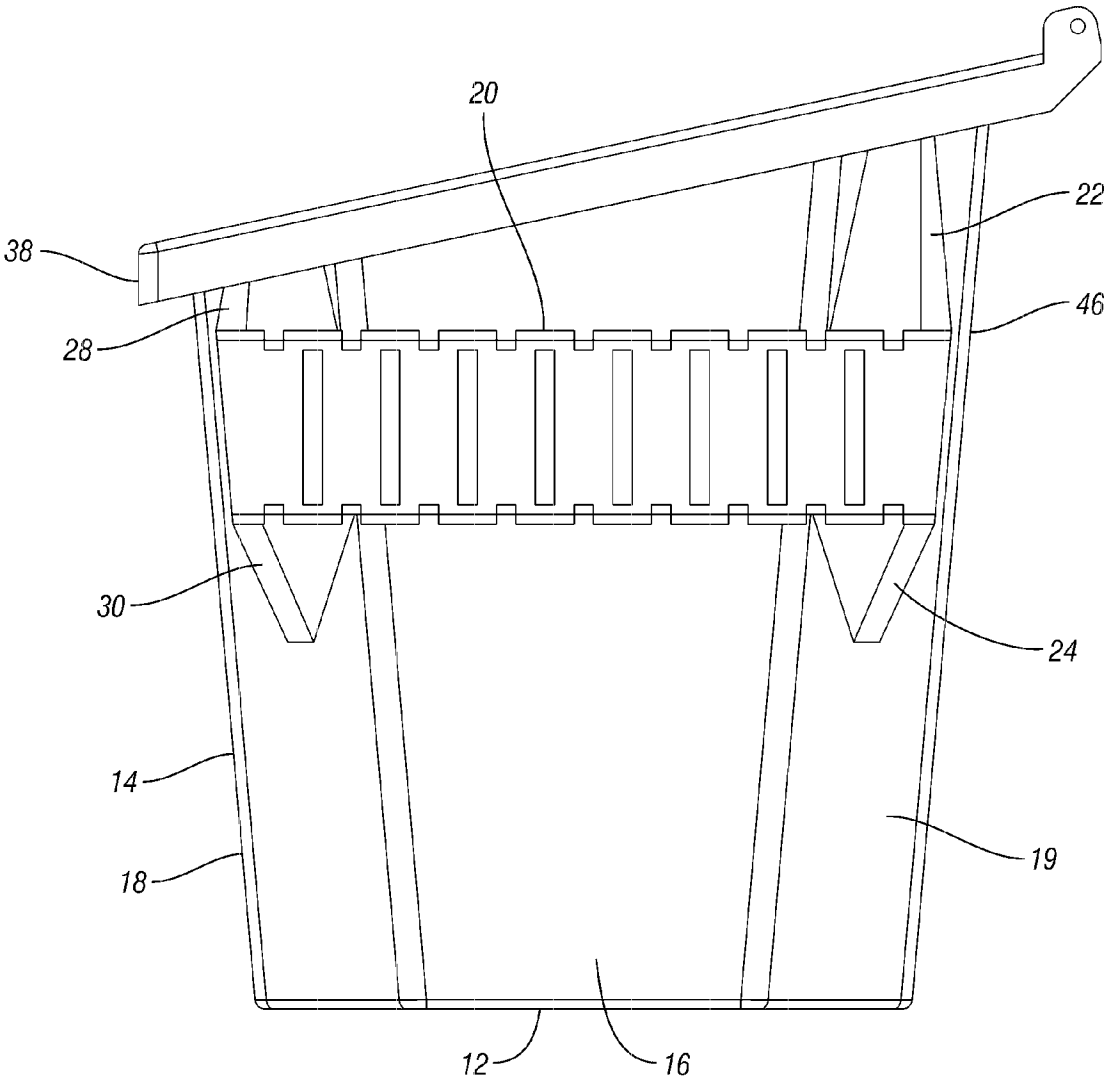
FIG. 3 is a side view of the dumpster of FIG. 1.

FIG. 2 is a front view of the dumpster 10. FIG. 3 is a side view of the dumpster 10, showing the gussets 22, 24, 28, 30 connected only to the bevel walls 18, 19.

Figure 4:
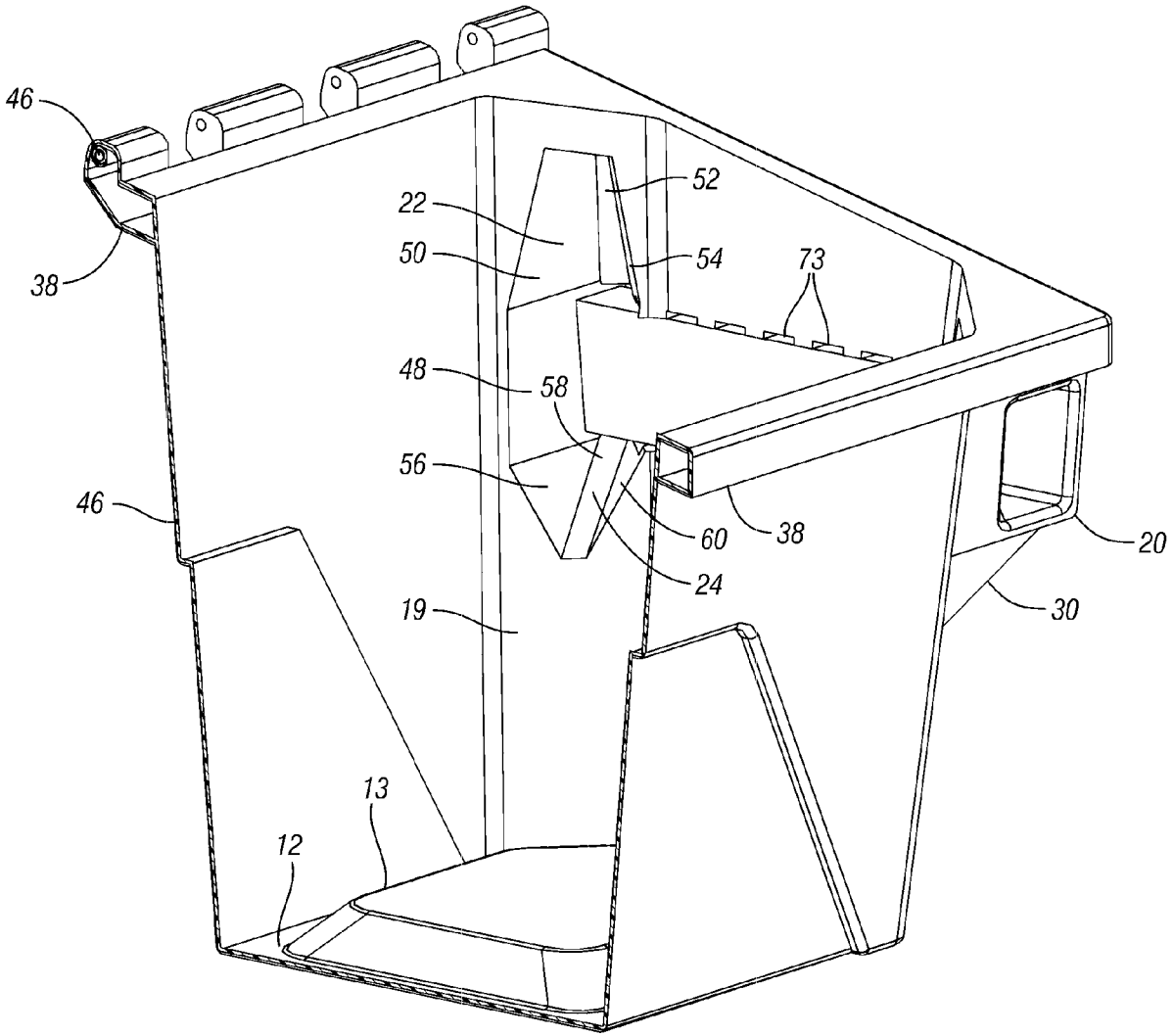
FIG. 4 is a section view of the dumpster of FIG. 1.

FIG. 4 is a perspective interior view of the dumpster 10, partially broken away. The base 12 may include convex portions 13 for reinforcement. The lip 38 is hollow, as shown. A center wall 48 extends outwardly from the rear bevel wall 19 to the pocket 20. The gussets 22, 24 on the rear bevel wall 19 are open to the interior of the dumpster 10. The upper gusset 22 includes a first wall 50 extending from the rear bevel wall 19 to the center wall 48, a second wall 52 adjacent the first wall 50 and extending from the rear bevel wall 19 to an area proximate the outer edge of the pocket 20 and a third wall 54 adjacent the second wall 52 and extending from the bevel wall 19 across a portion of the pocket 20.

Similarly, the lower gusset 24 includes a first wall 56 extending upwardly from the rear bevel wall 19 to the center wall 48, a second wall 58 adjacent the first wall 56 and extending from the rear bevel wall 19 to an area proximate the outer edge of the pocket 20 and a third wall 60 adjacent the second wall 58 and extending from the bevel wall 19 across a portion of the pocket 20.

As can be seen in FIG. 4, apertures 73 are formed through the side wall 16 above and below the pocket 20.

Figure 5:
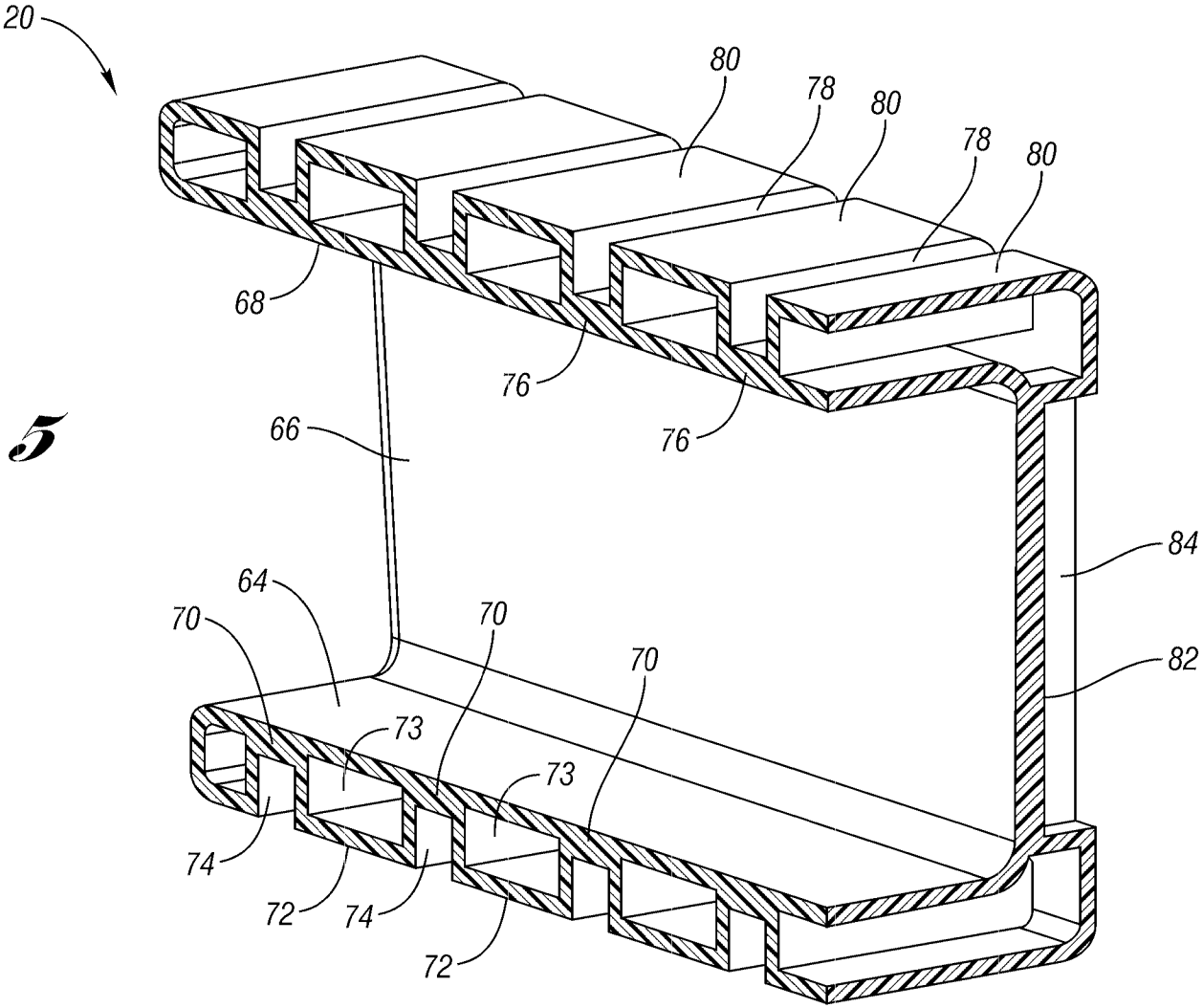
FIG. 5 is a section view through one of the pockets of the dumpster of FIG. 1.
Figure 6:
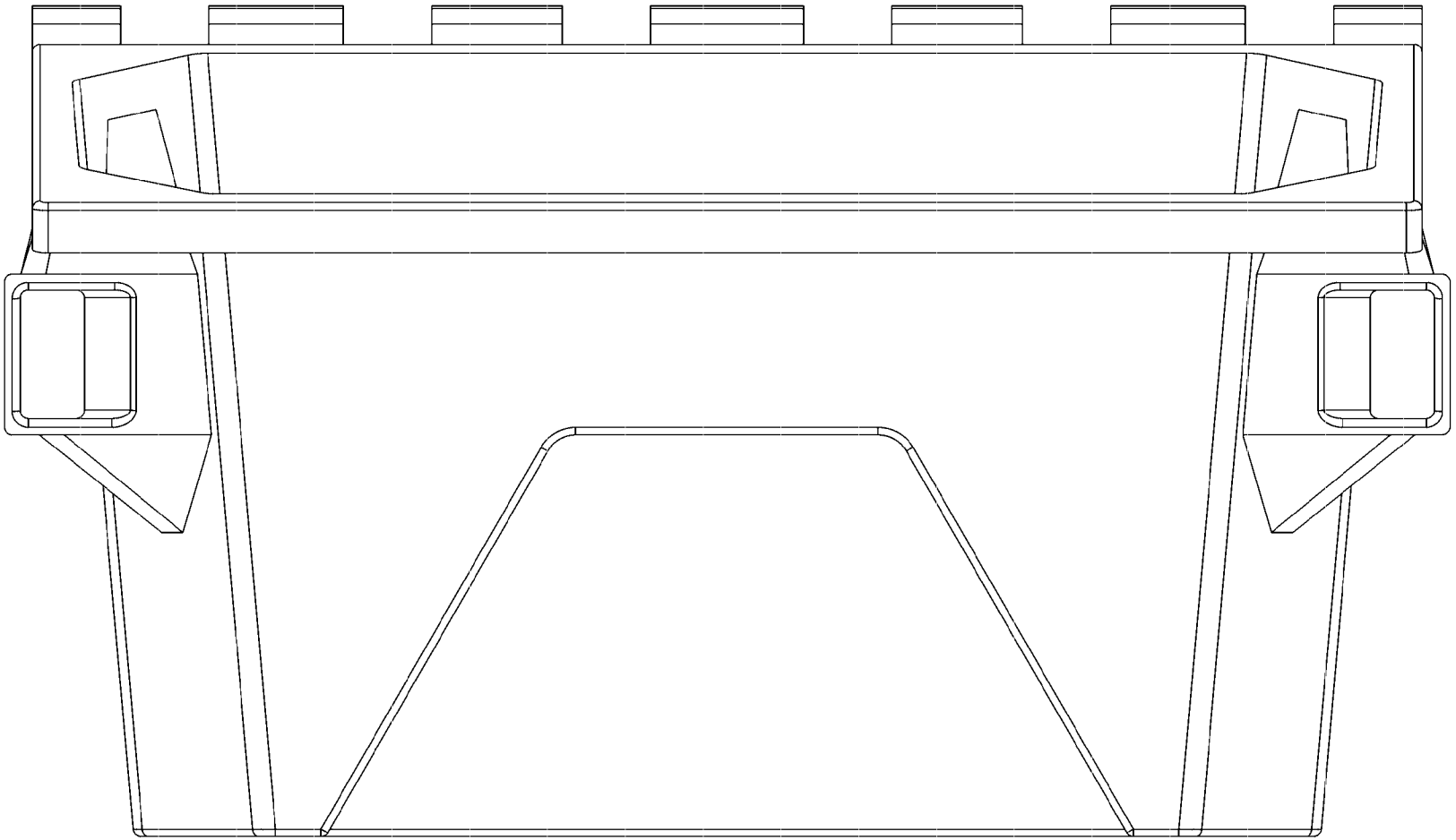
FIG. 6 is a front view of the dumpster of FIG. 1.
Figure 7:
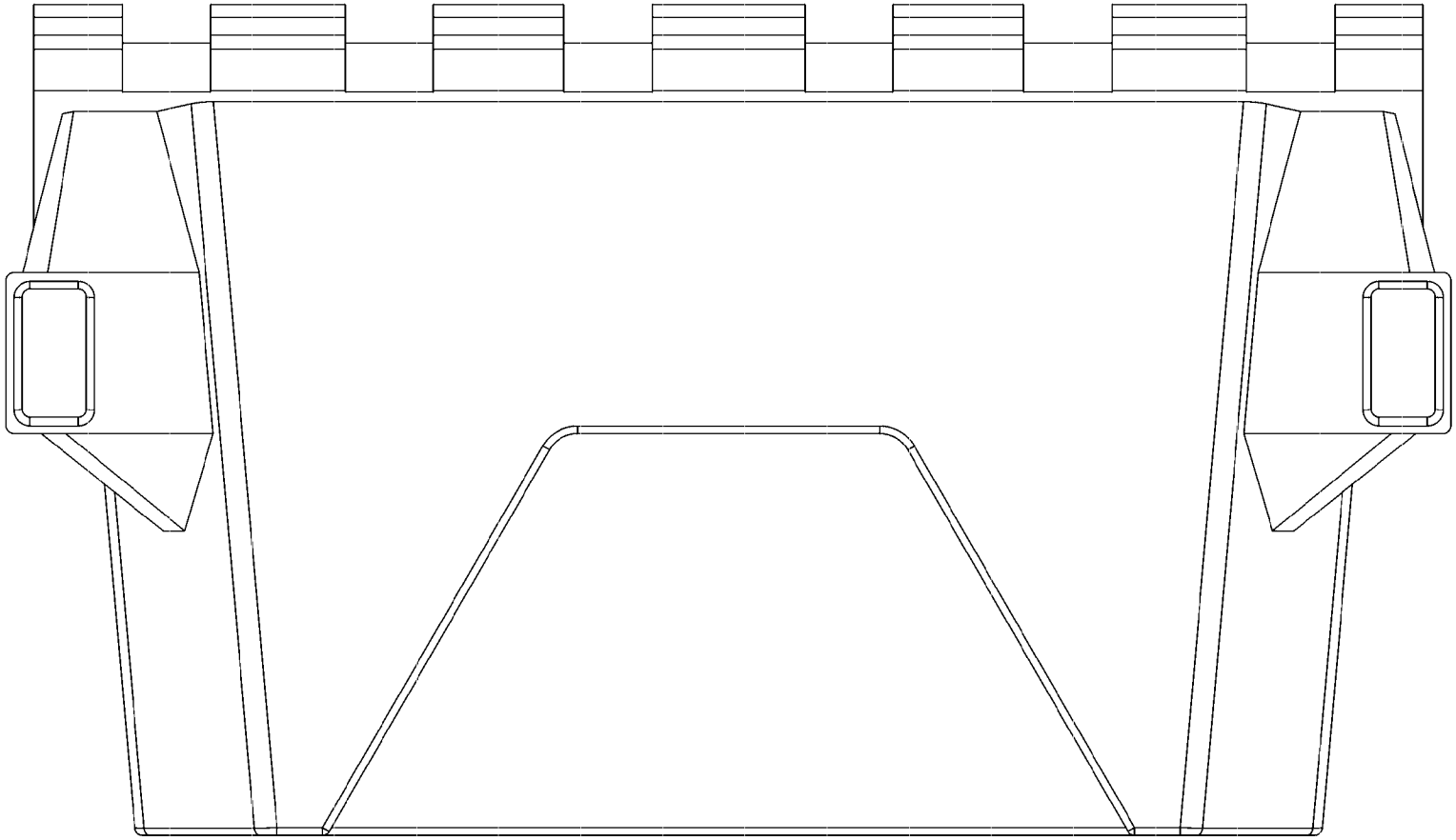
FIG. 7 is a rear view of the dumpster of FIG. 1.
Figure 8:
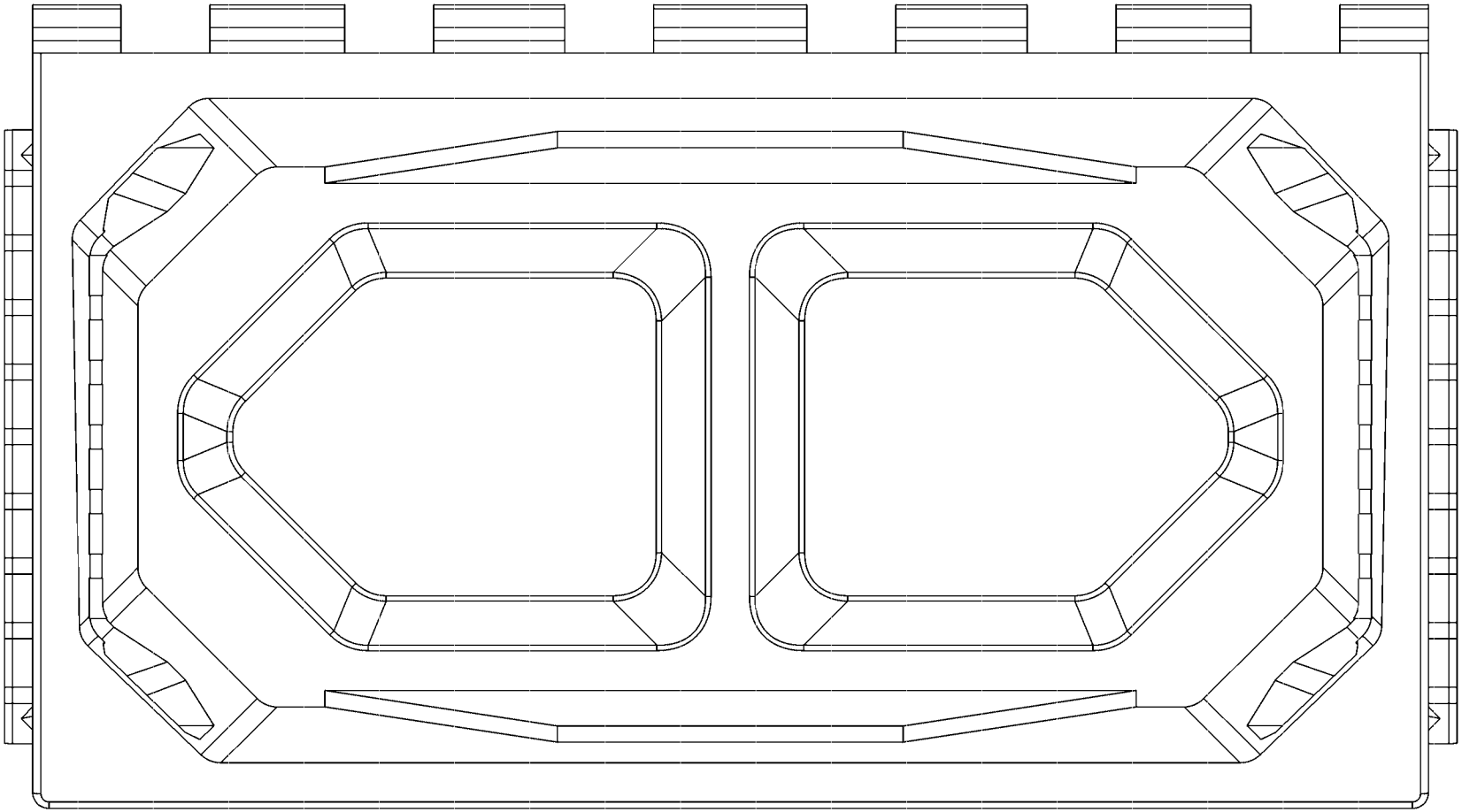
FIG. 8 is a top view of the dumpster of FIG. 1.
Figure 9:
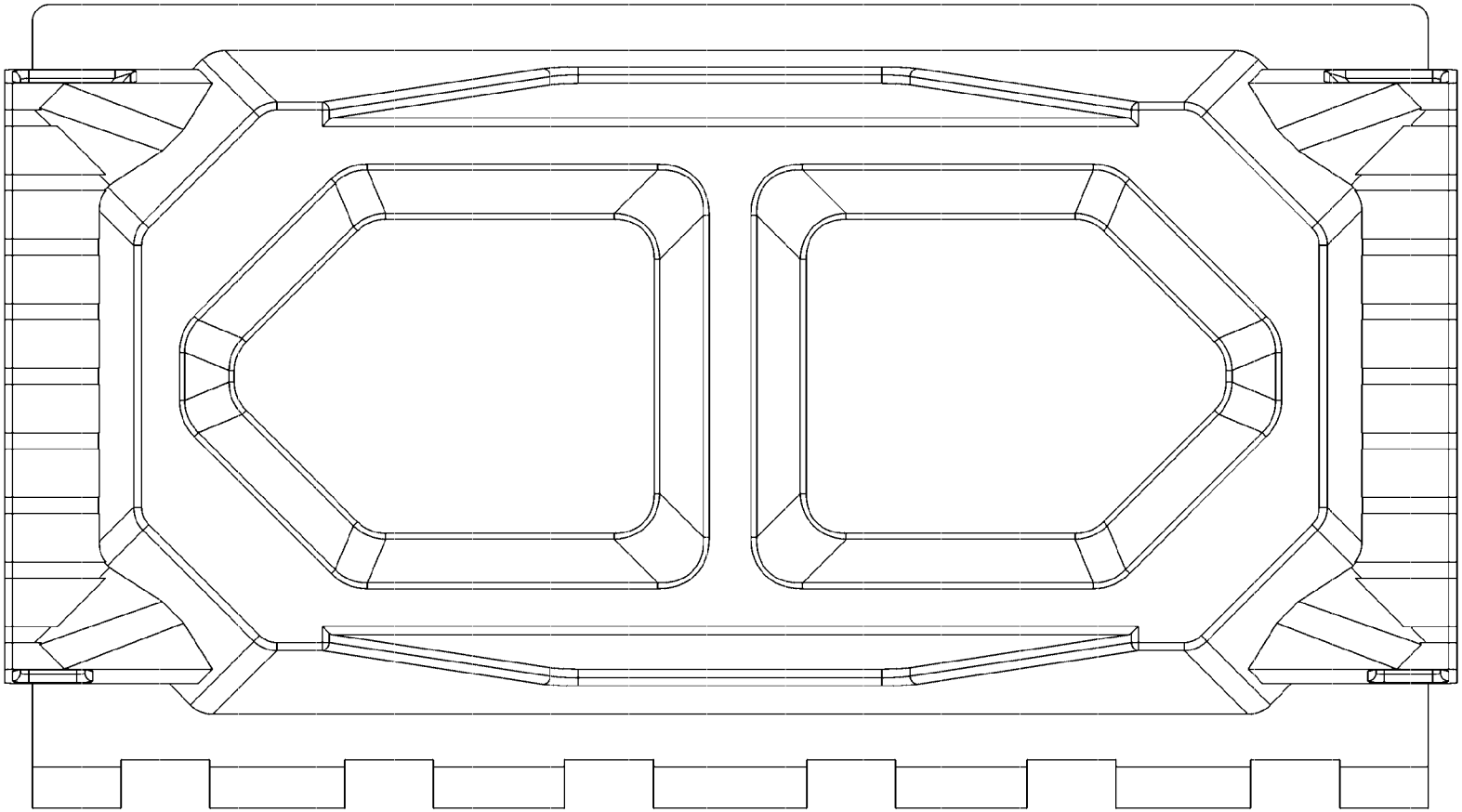
FIG. 9 is a bottom view of the dumpster of FIG. 1.

The apertures 73 are also shown in FIG. 5, which illustrates a portion of the pocket 20, sectioned laterally and longitudinally. The pocket 20 includes an upper wall 68, a lower wall 64 and an outer wall 66. The upper wall 68 includes alternating single wall sections 76 and box beam sections 80, thereby defining alternating channels 78 above the single wall sections 76 between the box beam sections 80. The box beam sections 80 define apertures 73 that open to the interior of the dumpster 10 (FIG. 3). The lower wall 64 includes alternating single wall sections 70 and box beam sections 72, thereby defining alternating channels 74 above the single wall sections 70 between the box beam sections 72. The box beam sections 72 define apertures 73 that open to the interior of the dumpster 10 (FIG. 3).

FIGS. 6-9 are front, rear, top and bottom views of the dumpster 10, without the lids 40 or casters 36.

Figure 10:
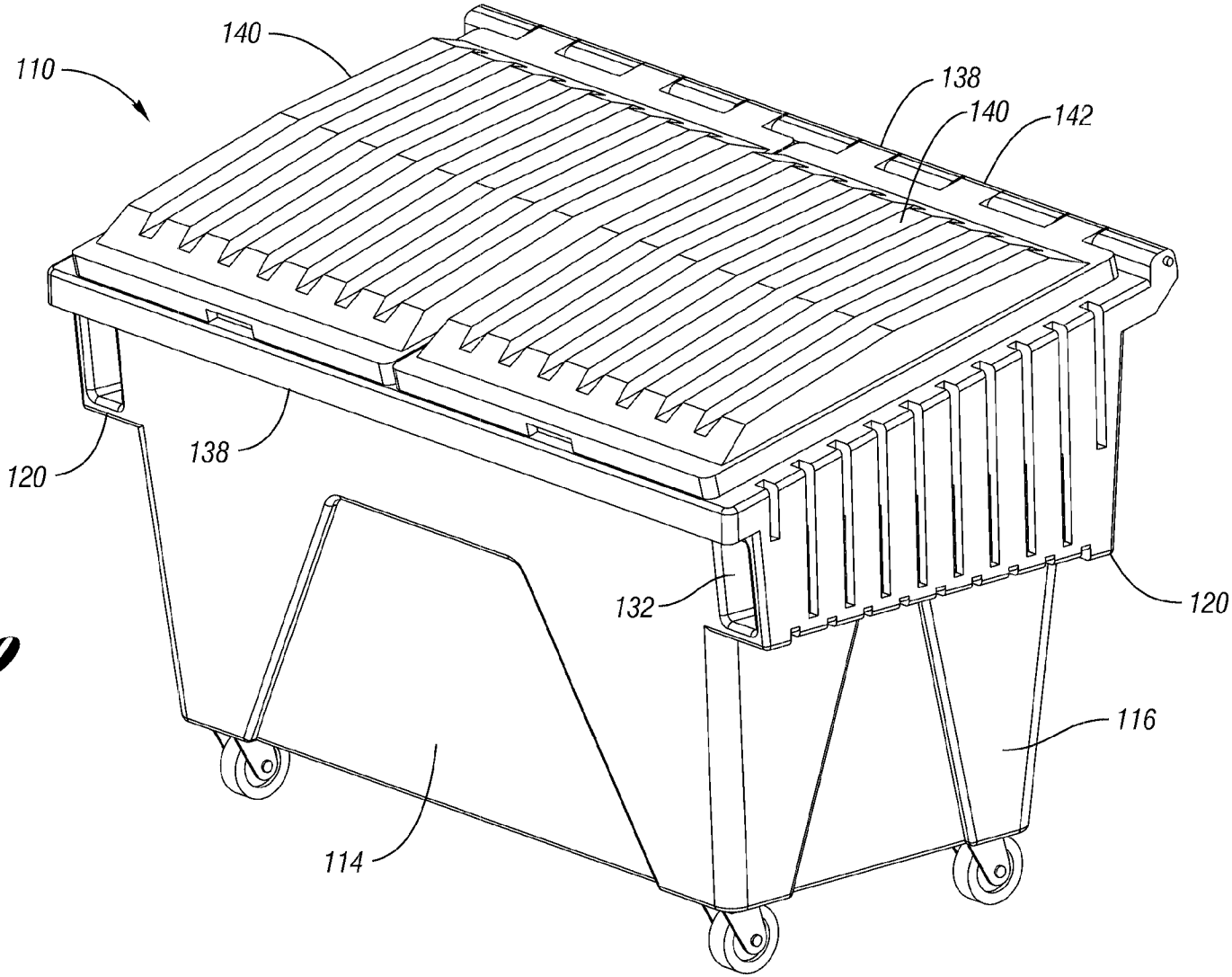
FIG. 10 is a perspective view of a dumpster according to a second embodiment.

FIG. 10 is a perspective view of a dumpster 110 according to a second embodiment. The dumpster 110 includes a base wall, front wall 114, side walls 116 and a rear wall 146 defining an interior of the dumpster 110. The dumpster 110 includes pockets 120 adjacent each side wall 116. The pockets 120 define openings 132 for receiving a fork of a truck. A lip 138 is defined around the upper edges of the walls. Lids 140 may be connected via a hinge 142.

Each pocket 120 is supported by the front wall 114 and rear wall 146 which extends outward continuously to circumscribe the opening 132 of the pocket 120.

Figure 11:
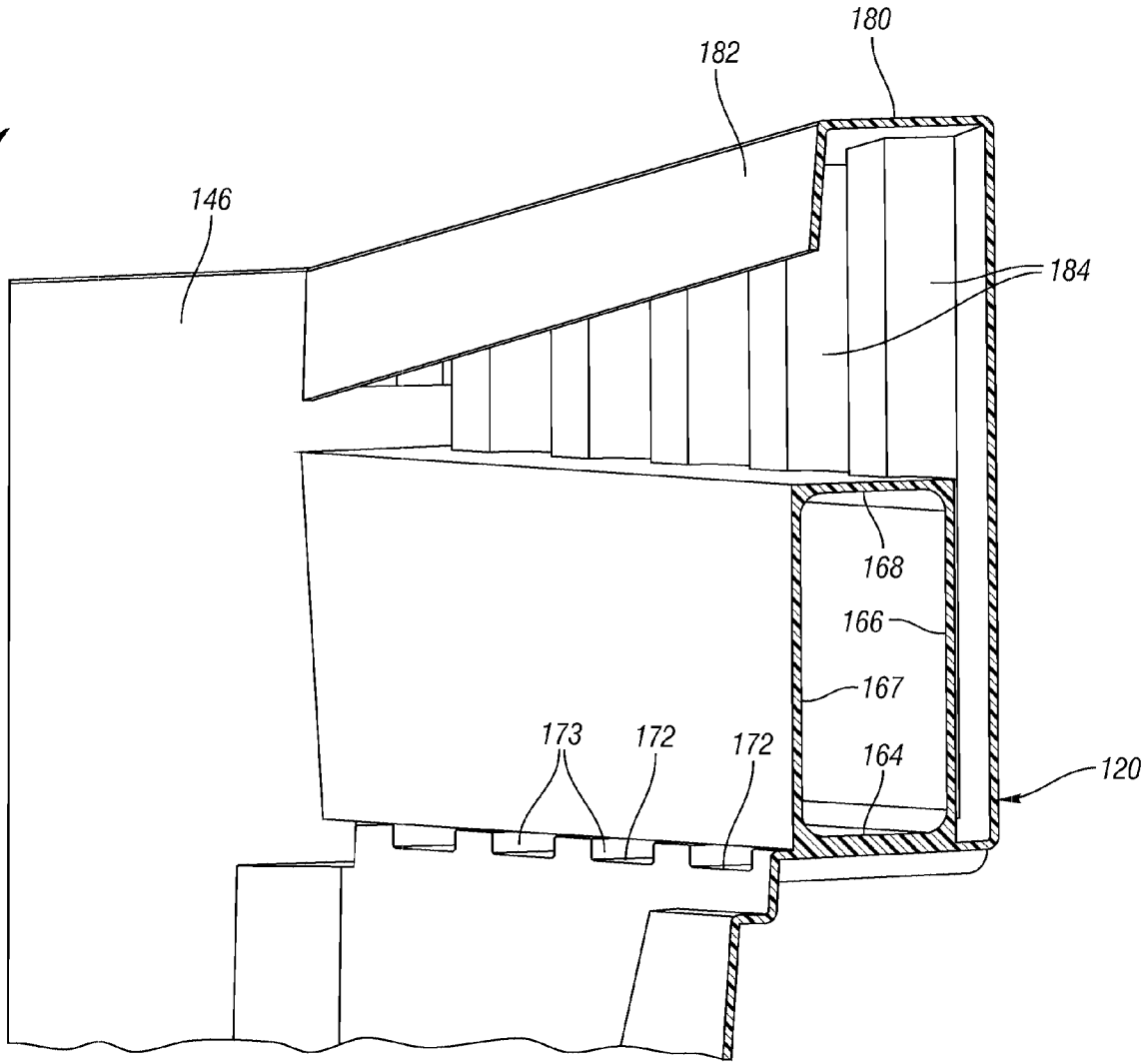
FIG. 11 is a section view through one of the pockets of the dumpster of FIG. 10.

FIG. 11 illustrates one of the pockets 120 in more detail in section. The pocket 120 includes a lower wall 164, outer wall 166, inner wall 167 and upper wall 168 that define the opening 132 through the pocket 120. The lower wall 164 is formed similarly to that of the embodiment of FIGS. 1-9, having box beam sections 172 having openings 173 into the interior of the dumpster 110. Over the side walls 116, the lip 138 includes an upper wall 180 having an inner flange 182 extending downward from an inner edge thereof. A corrugated wall 184 extends downward from the outer edge of the upper wall 180 down to the upper wall 168 of the pocket 120. The corrugations increase the rigidity and strength of the corrugated wall 184 to further support the pocket 120, although most of the support for the pocket 120 comes from the front wall 114 and rear wall 146. When the dumpster 110 is lifted by the fork, most of the weight of the dumpster 110 and its contents is transferred directly to the front wall 114 and rear wall 146.

Figure 12:
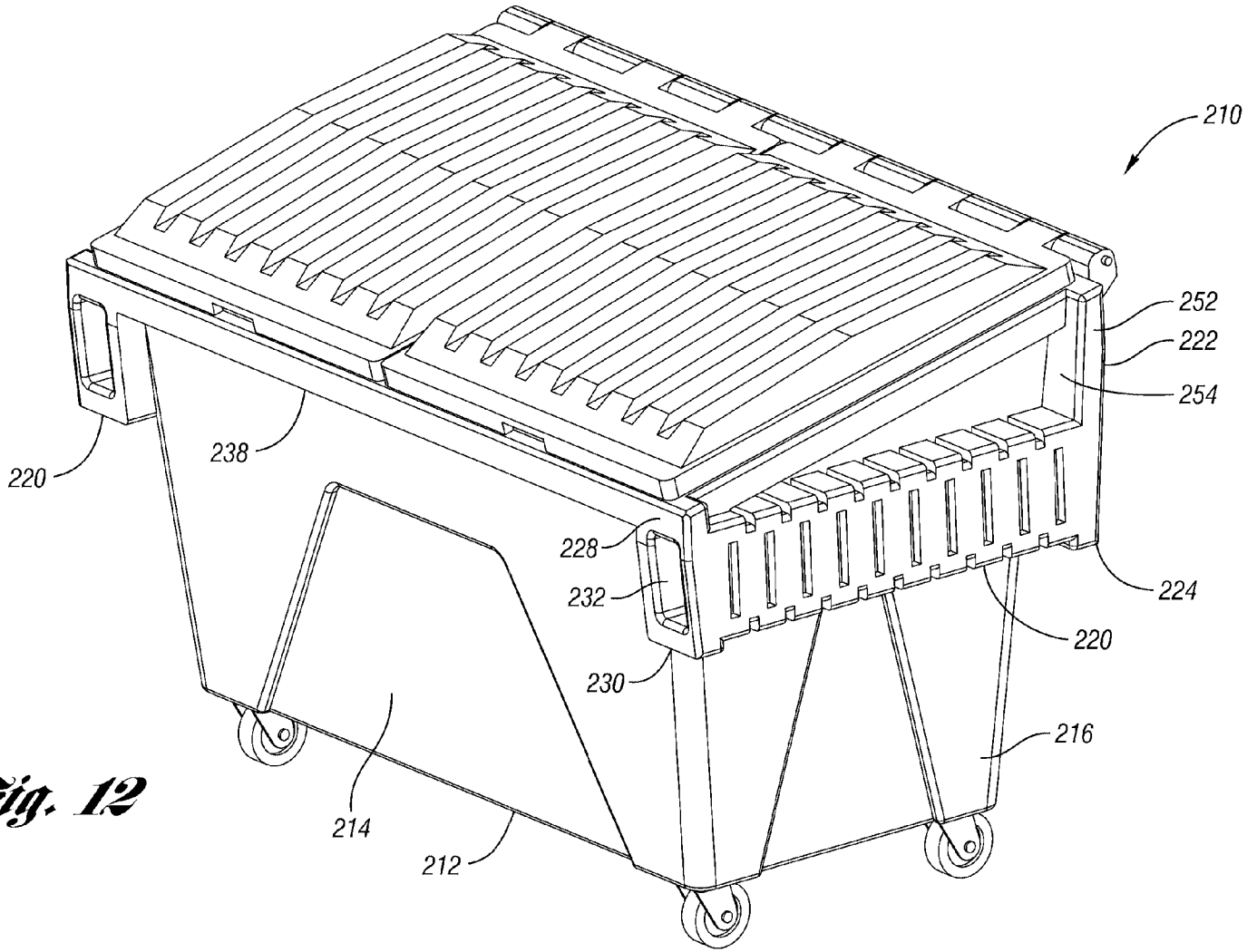
FIG. 12 is a perspective view of a dumpster according to a third embodiment.
Figure 13:
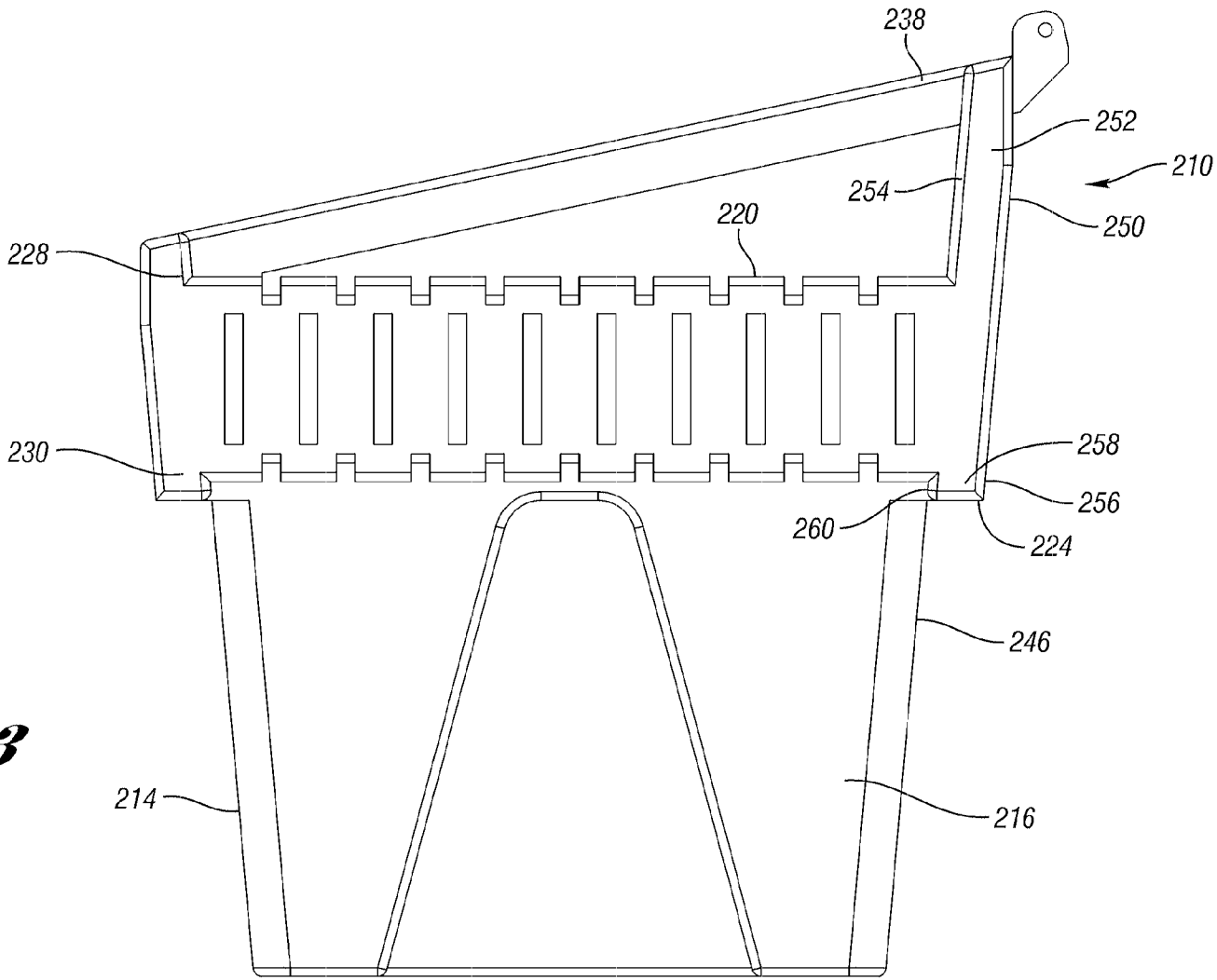
FIG. 13 is a side view of the dumpster of FIG. 12.
Figure 14:
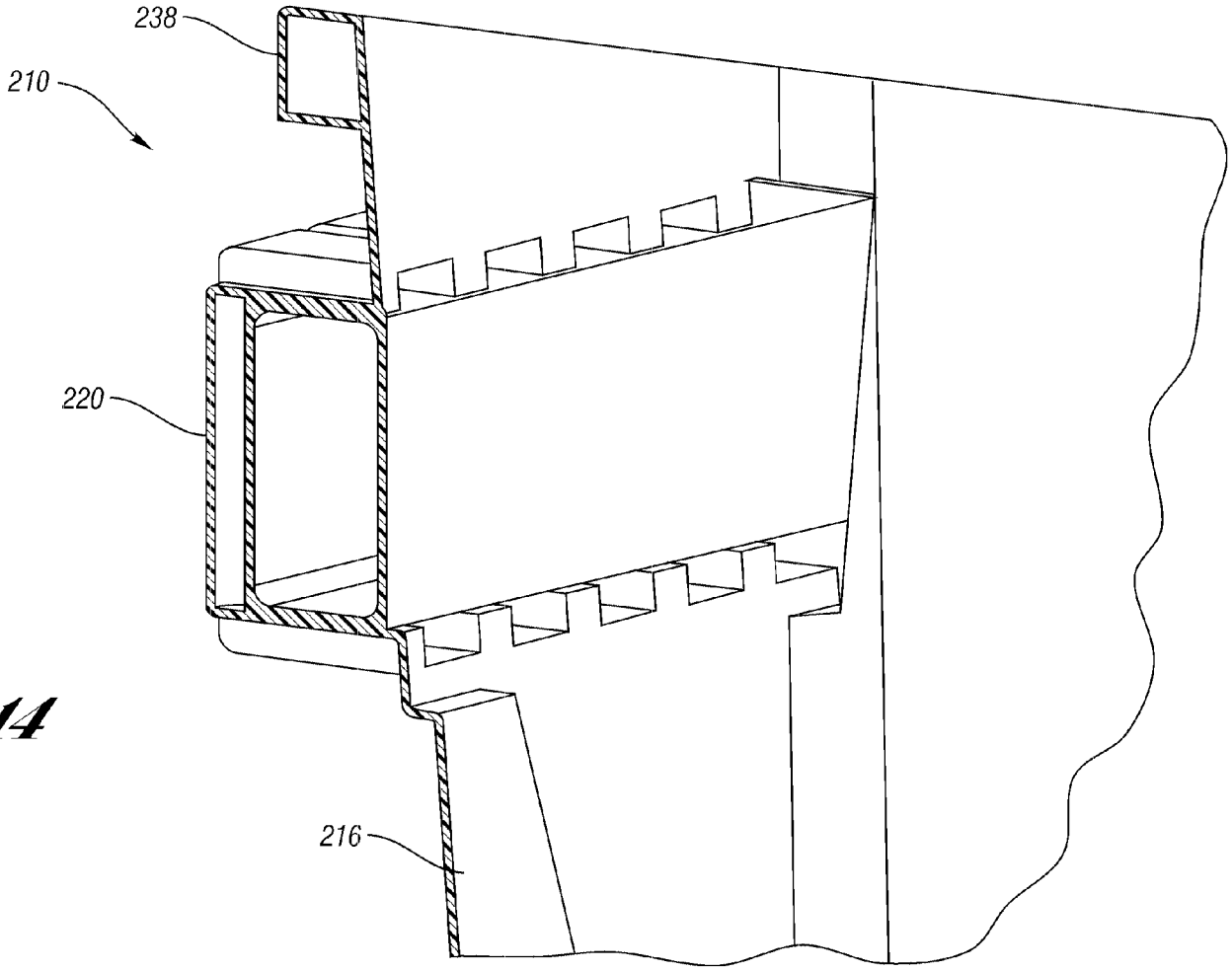
FIG. 14 is a section view through one of the pockets of the dumpster of FIG. 12.

FIGS. 12-14 illustrate a dumpster 210 according to a third embodiment. The dumpster 210 includes a base wall 212, front wall 214, side walls 216 and rear wall 246. Pockets 220 are adjacent side walls 214 and are reinforced by rear gussets 222, 224 and front gussets 228, 230.

Referring to FIG. 13, the upper rear gusset 222 includes a first wall 250, second wall 252 and third wall 254 all supporting the pocket 220. The third wall 254 is generally parallel to the rear wall 246 of the dumpster 210 so that weight is transferred directly to the side wall 216, while the first wall 250 is generally a continuous extension of the outer wall of the lip 238. Similarly, the lower rear gusset 224 includes a first wall 256, second wall 258 and third wall 260, with the third wall 260 being generally parallel to the rear wall 246 of the dumpster 210 and connected to the side wall 216.

The front gussets 228, 230 each have three walls extending to the pocket 220 in a similar manner, such that the innermost walls of the gussets 228, 230 are generally continuous extensions of the front wall 214. Additionally, the outermost wall of the upper gusset 228 is generally a continuous extension of the outer wall of the lip 238.

Referring to FIG. 14, the pocket 220 has walls that are generally formed with alternating single wall sections and box beam sections, as described above with respect to the embodiment of FIGS. 1-9.

Figure 15:
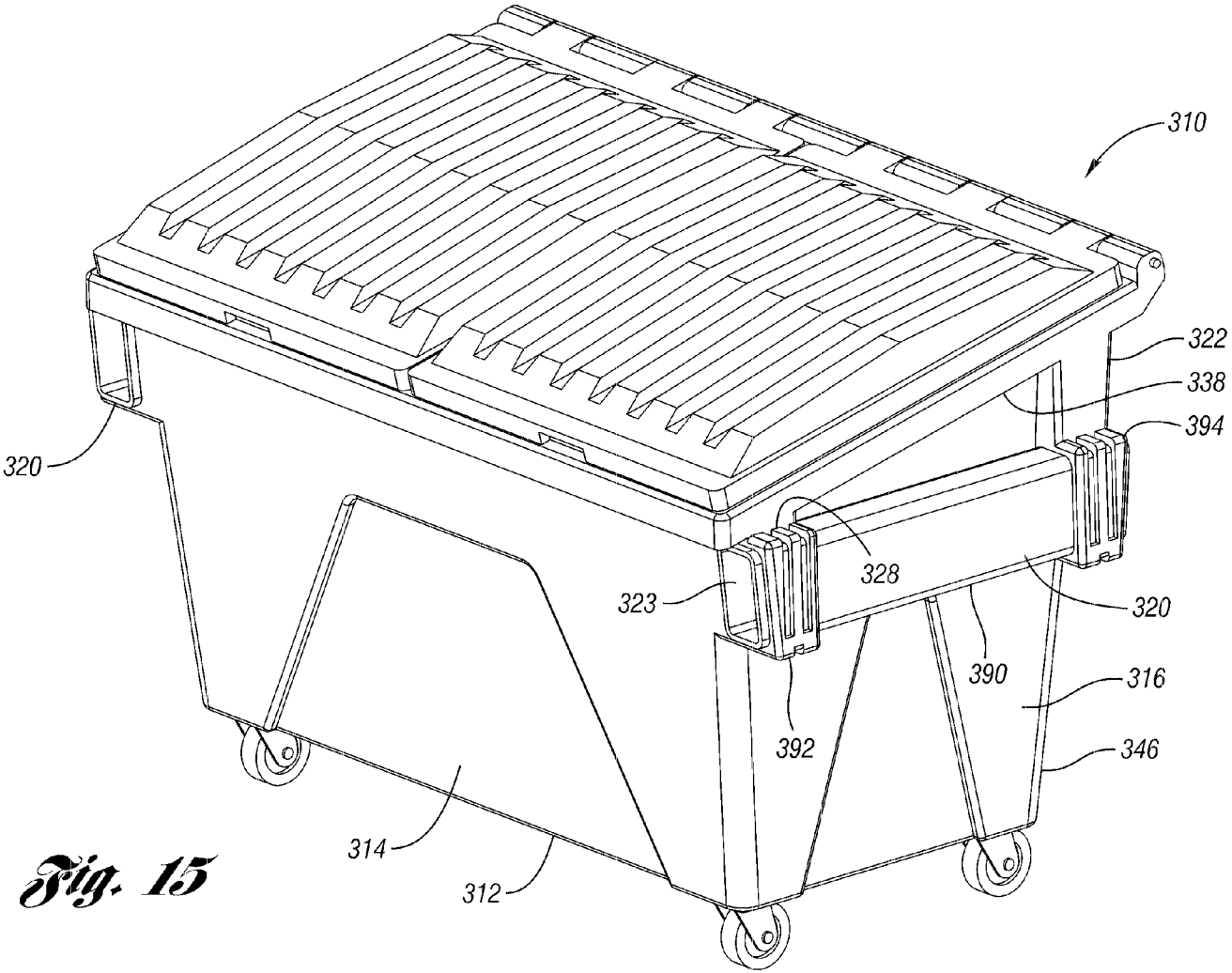
FIG. 15 is a perspective view of a dumpster according to a fourth embodiment.
Figure 16:
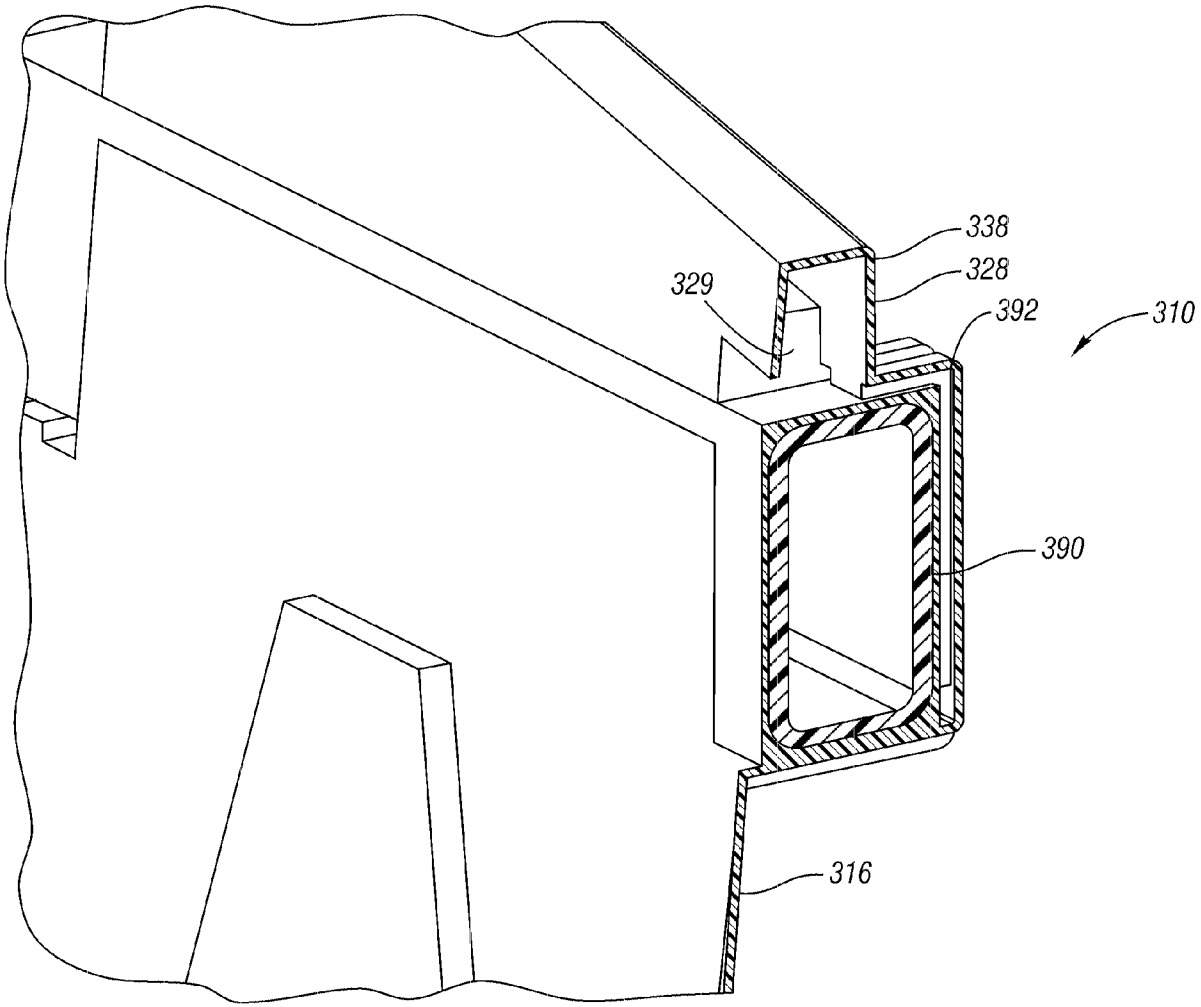
FIG. 16 is a section view through one of the pockets of the dumpster of FIG. 15.

FIGS. 15 and 16 illustrate a dumpster 310 according to a fourth embodiment. The dumpster 310 includes a base wall 312, front wall 314, side walls 316 and rear wall 346. The pockets 320 are each formed by a sleeve 390 inserted (or, alternatively, insert-molded) into a front support 392 and a rear support 394.

The supports 392, 394 are reinforced by gussets 328, 322. Additional gussets below the supports 392, 394 could optionally be used. Referring to FIG. 16, the upper front gusset 328 includes a wall 329 extending perpendicularly to the side wall 316 and to the pocket 320.

The sleeves 390 could be formed of a material different from that of the rest of the dumpster 310. For example, the sleeves 390 could be metal, or the sleeves 390 could be a higher-density polymer. If plastic, the sleeves 390 could be injection molded or extruded. The sleeves 390 could be removable, such that damaged sleeves 390 could be replaced.

Figure 17:
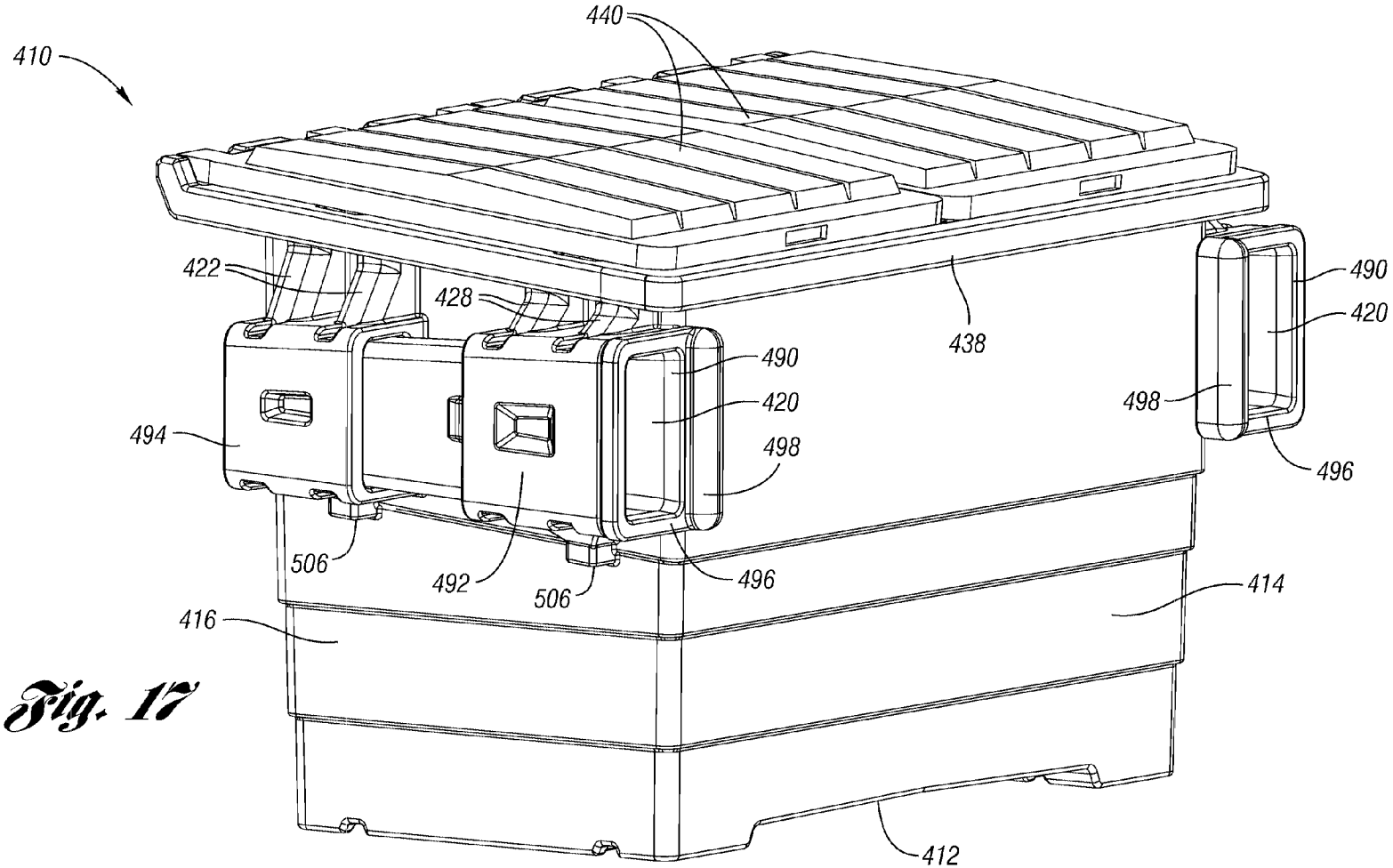
FIG. 17 is a perspective view of a dumpster according to a fifth embodiment.
Figure 18:
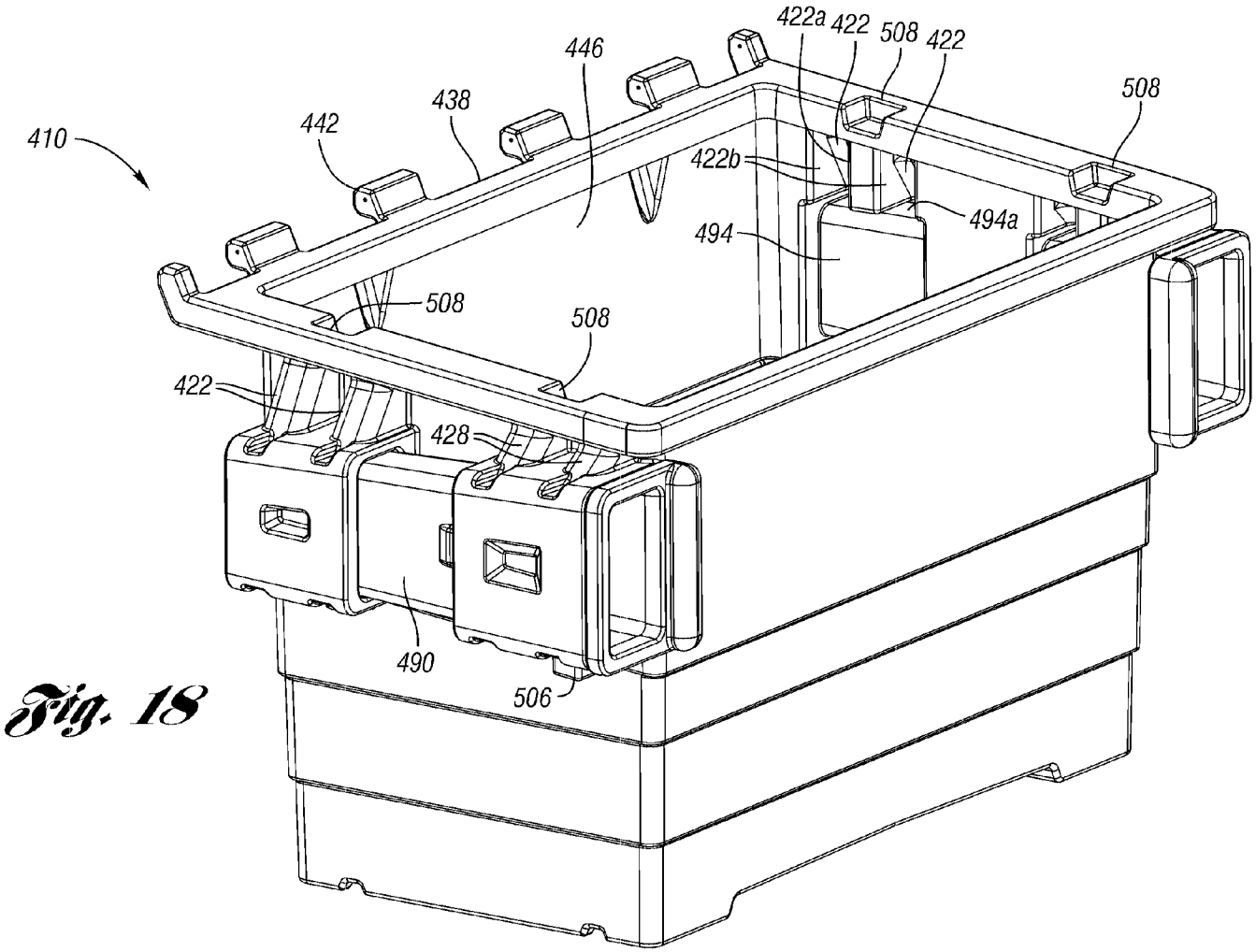
FIG. 18 shows the dumpster of FIG. 17 with the lids removed.

A dumpster 410 according to a fifth embodiment is shown in FIGS. 17-21. Referring to FIG. 17, the dumpster 410 includes a base wall 412, front wall 414, side walls 416 and rear wall 446 (FIG. 18). A hollow lip 438 extends around the upper edge of the periphery of the dumpster 410. Lids 440 are hingeably mounted on the dumpster 410. Pockets 420 are each formed by a sleeve 490 inserted (or, alternatively, insert-molded) into a front support 492 and a rear support 494.

The supports 492, 494 are reinforced by upper gussets 428, 422. Stacking posts 506 are formed below the supports 492, 494. The sleeves 490 could be formed of a material different from that of the rest of the dumpster 410. For example, the sleeves 490 could be metal, or the sleeves 490 could be a higher-density polymer. The sleeves 490 could be removable, such that damaged sleeves 490 could be replaced. The sleeves 490 each include a front flange 496, including a large inner flange portion 498.

FIG. 18 shows the dumpster 410 with the lids removed to show the interior. The upper gusset 422 includes an outer wall **422*a* extending at an angle from the lip 438 to an inner wall 494*a* of the support 494. The upper gusset 422 also includes generally triangular side walls 422*b* extending between the side walls 416 of the dumpster 410 to the inner wall 494*a* of the support 494. The upper edge of the lip 438 includes stacking recesses 508 aligned with the stacking posts 506**.

Figure 19:
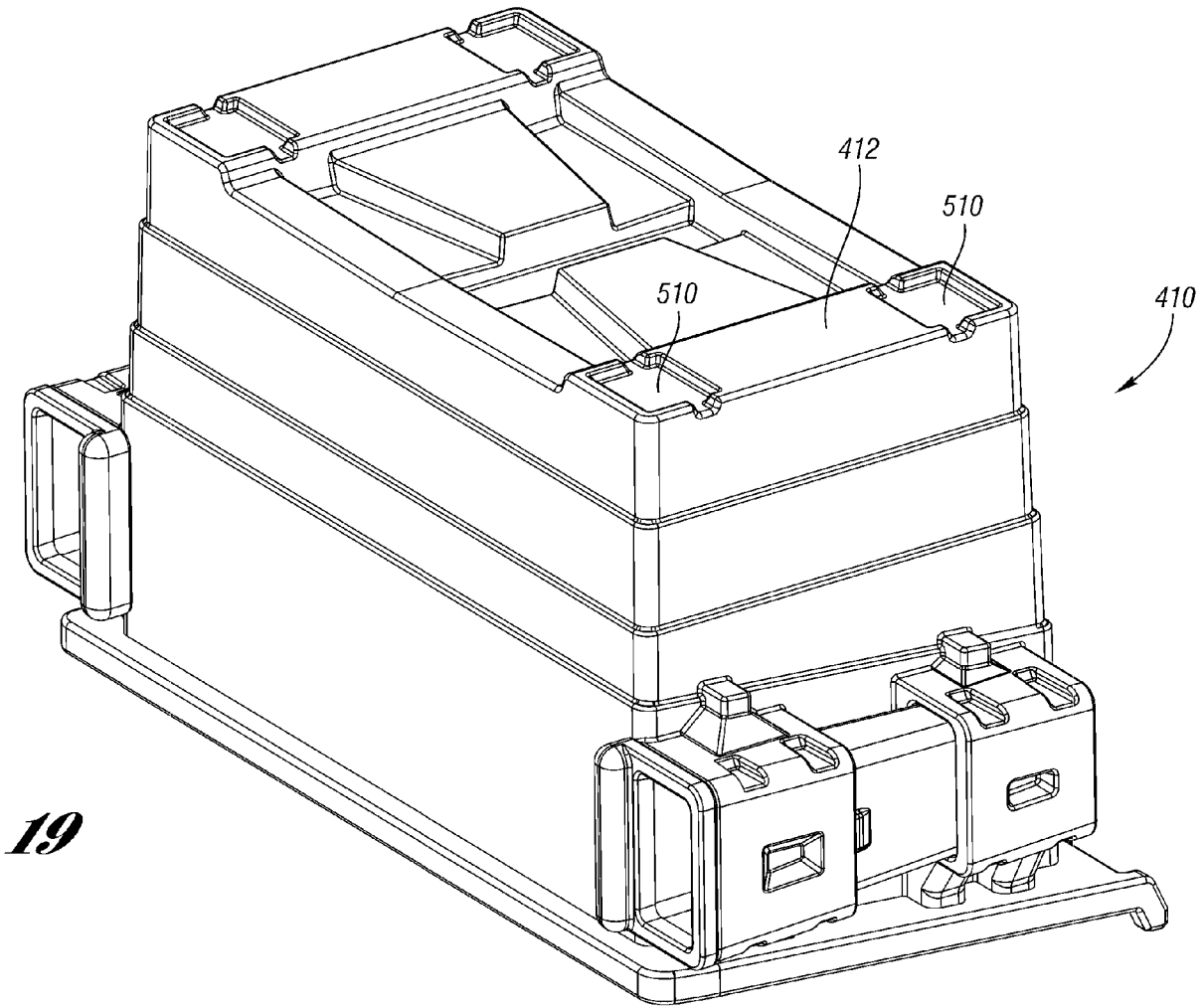
FIG. 19 is a bottom perspective view of the dumpster of FIG. 18.

FIG. 19 is a bottom perspective view of the dumpster 410 of FIG. 18. The base wall 412 includes a plurality of recesses 510 for receiving plates of casters (e.g. casters 36 of FIG. 1).

Figure 20:
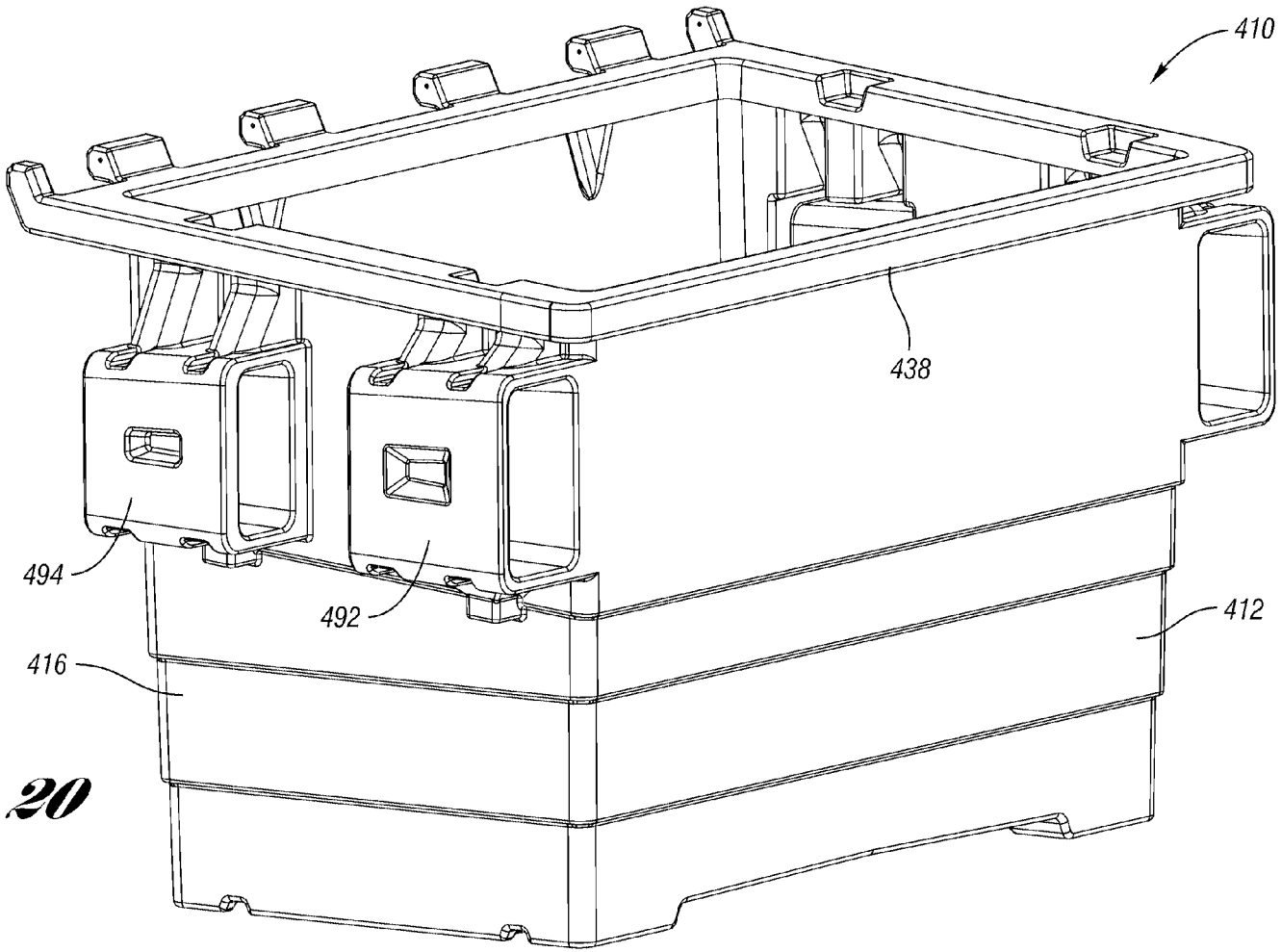
FIG. 20 shows the dumpster of FIG. 18 with the sleeves removed.

FIG. 20 shows the dumpster 410 without the lids 440 or sleeves 490. In the illustrated embodiment, what is shown in FIG. 20 is rotomolded as a single piece. The lids 440 and sleeves 490 are subsequently attached.

Figure 21:
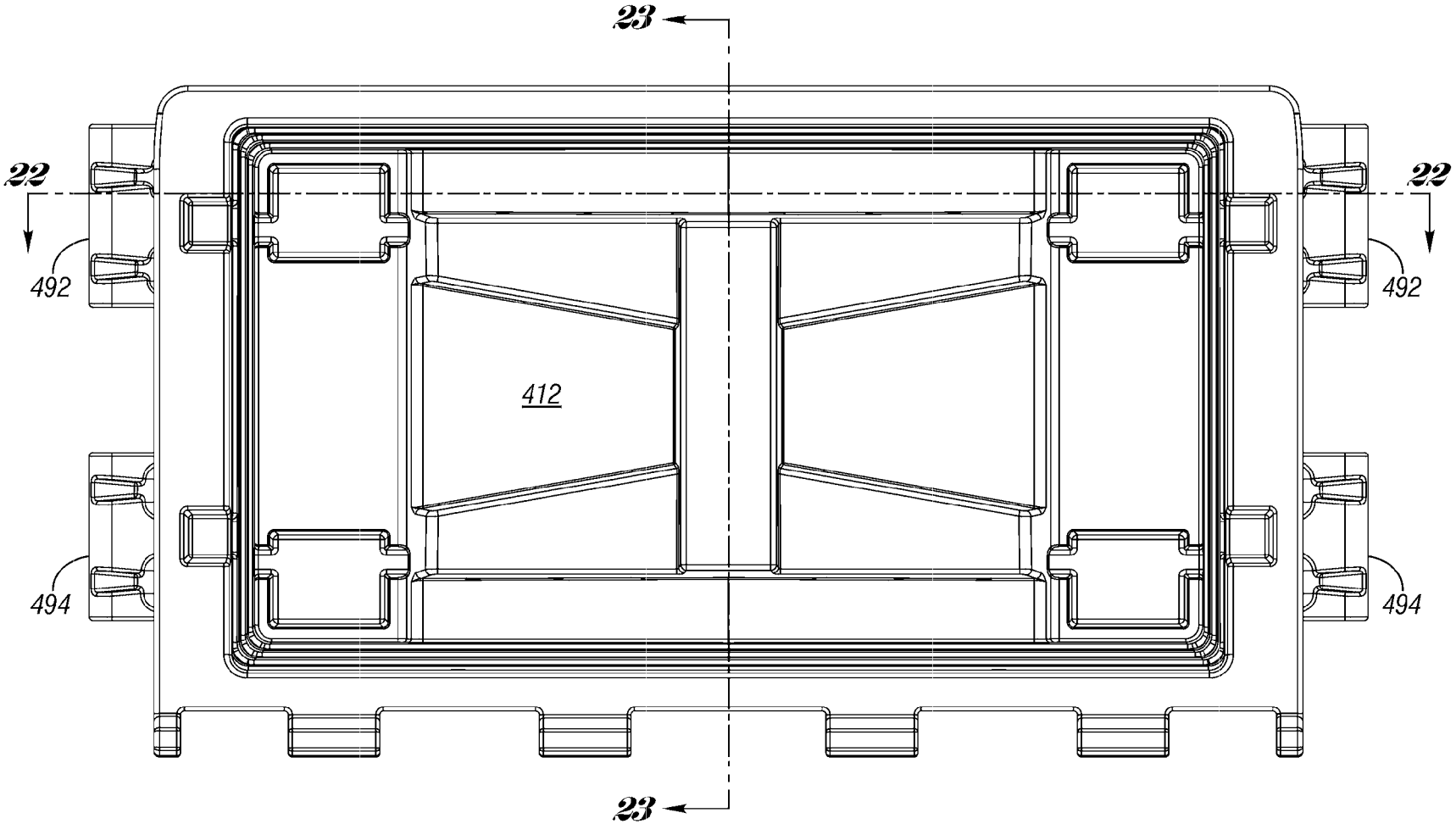
FIG. 21 is a top view of the dumpster of FIG. 20.
Figure 22:
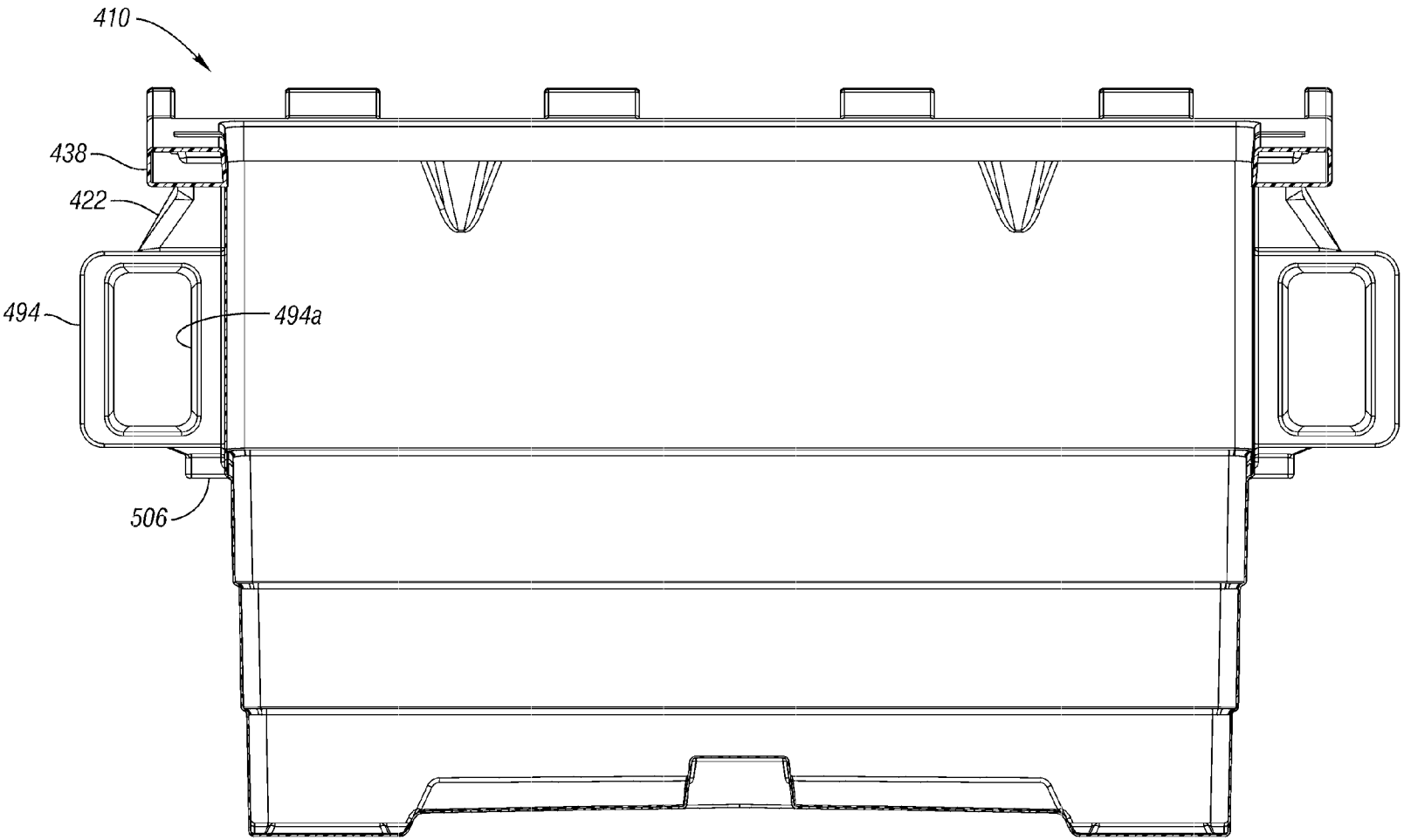
FIG. 22 is a section view taken along line 22-22 of FIG. 21.
Figure 23:
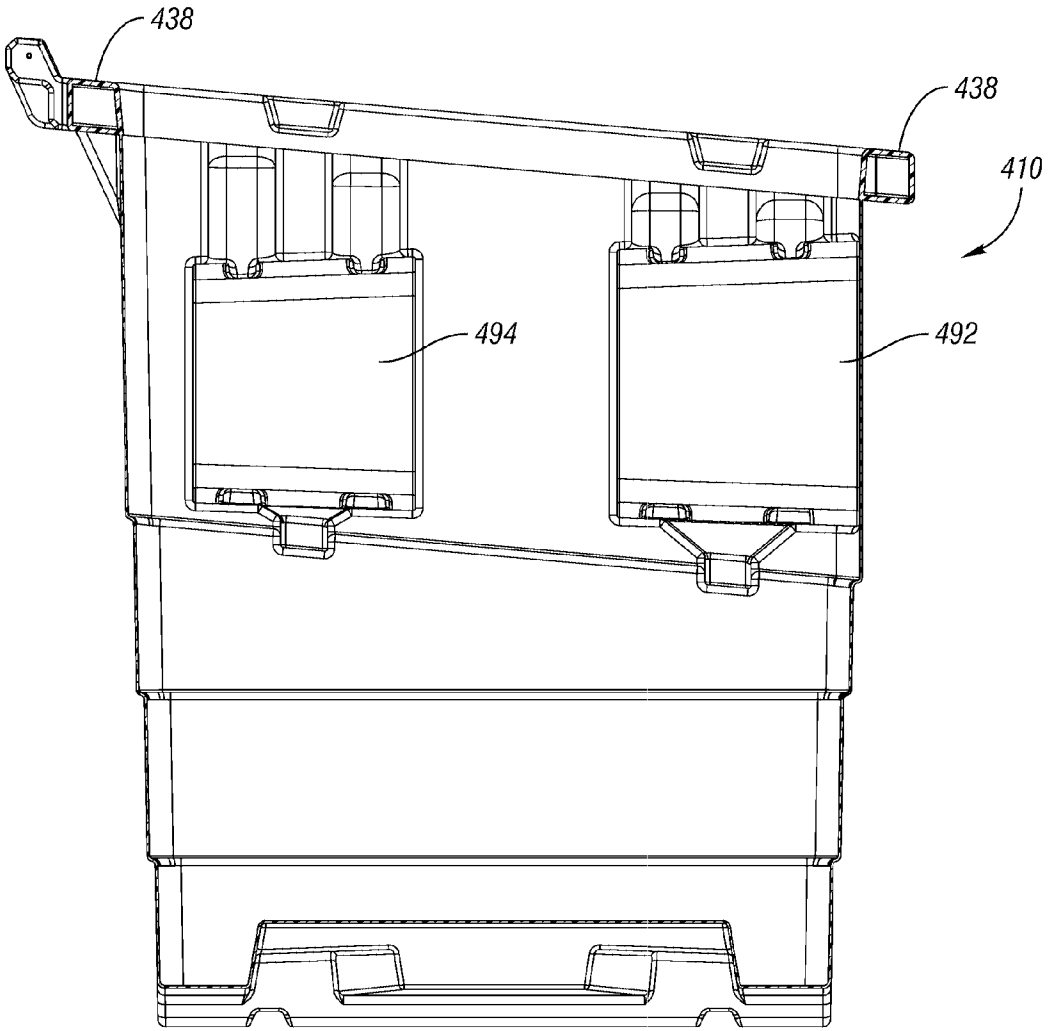
FIG. 23 is a section view taken along line 23-23 of FIG. 21.
Figure 24:
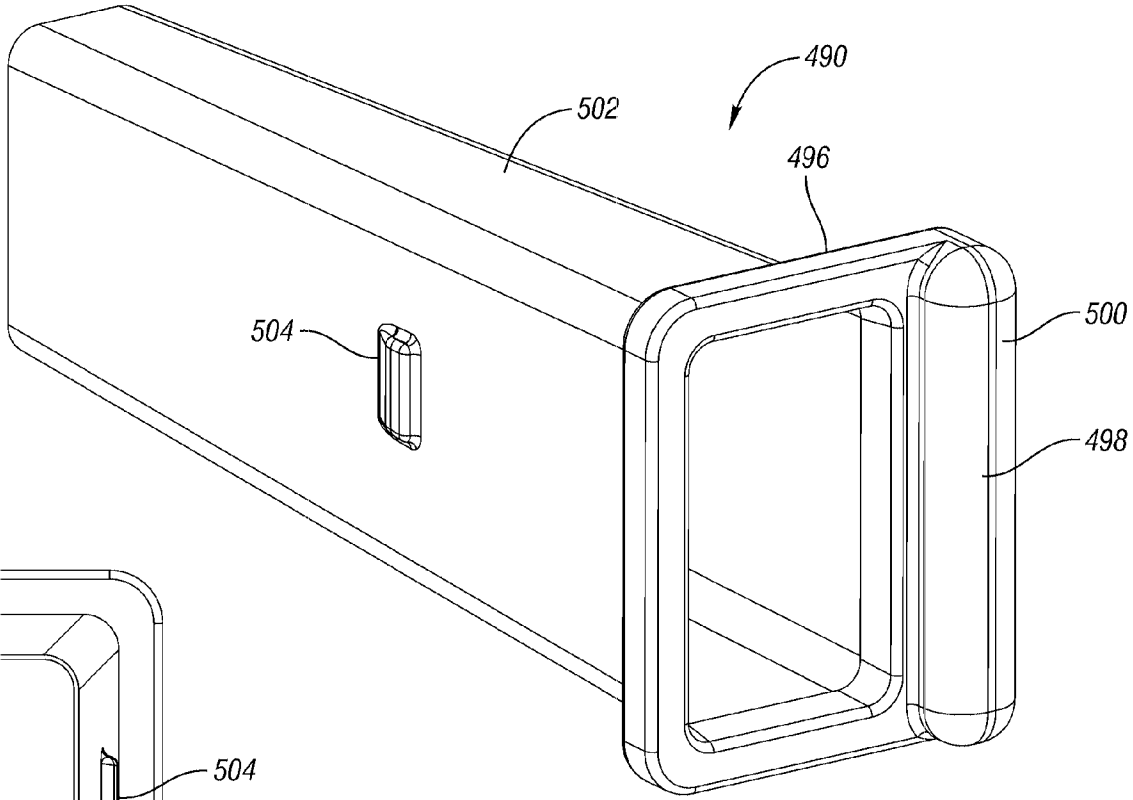
FIG. 24 is a perspective view of one of the sleeves of the dumpster of FIG. 17.

FIG. 21 is a top view of the dumpster 410 of FIG. 20. FIG. 22 is a section view taken along line 22-22 of FIG. 21. FIG. 23 is a section view taken along line 23-23 of FIG. 21. As shown, each pocket support 494 includes an inner wall **494*a* spaced inwardly of the pocket support 494**.

Figure 25:
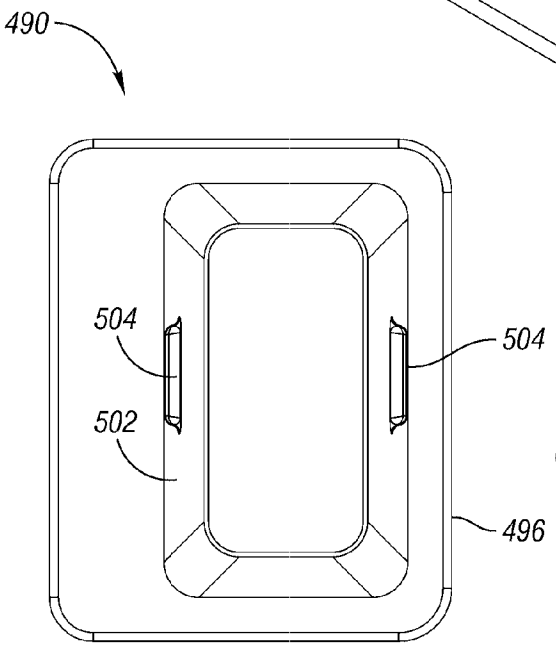
FIG. 25 is a rear view of the sleeve of FIG. 24.
Figure 26:
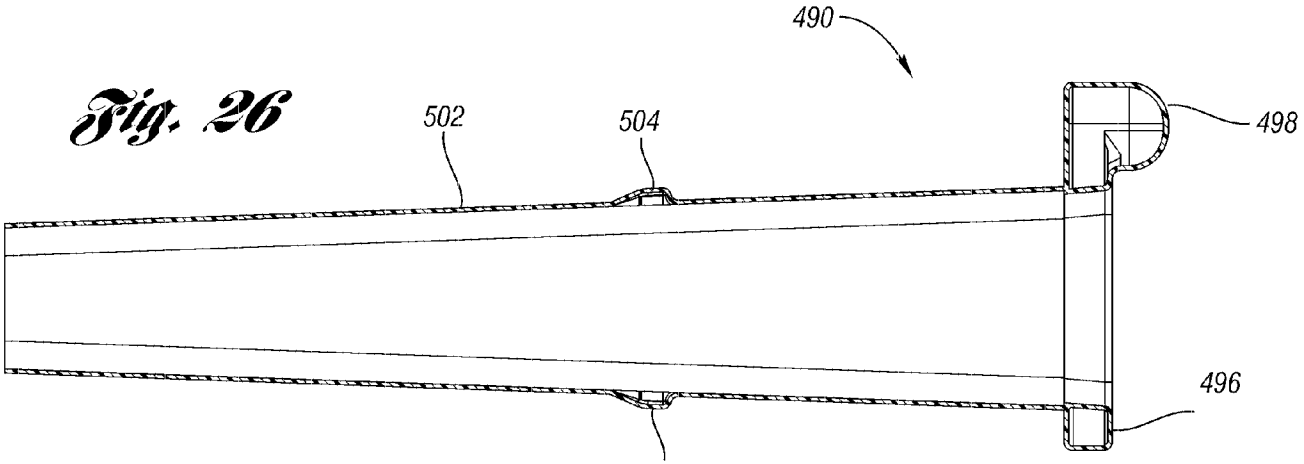
FIG. 26 is a horizontal section view through the sleeve of FIG. 24.
Figure 27:
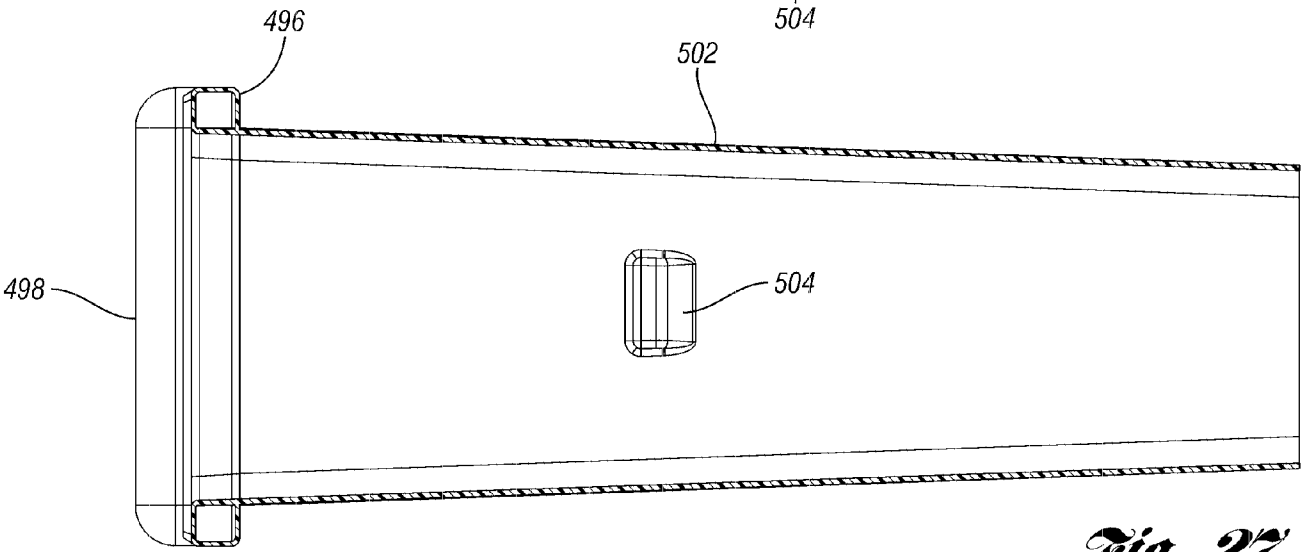
FIG. 27 is a vertical section view through the sleeve of FIG. 24.
Figure 28:
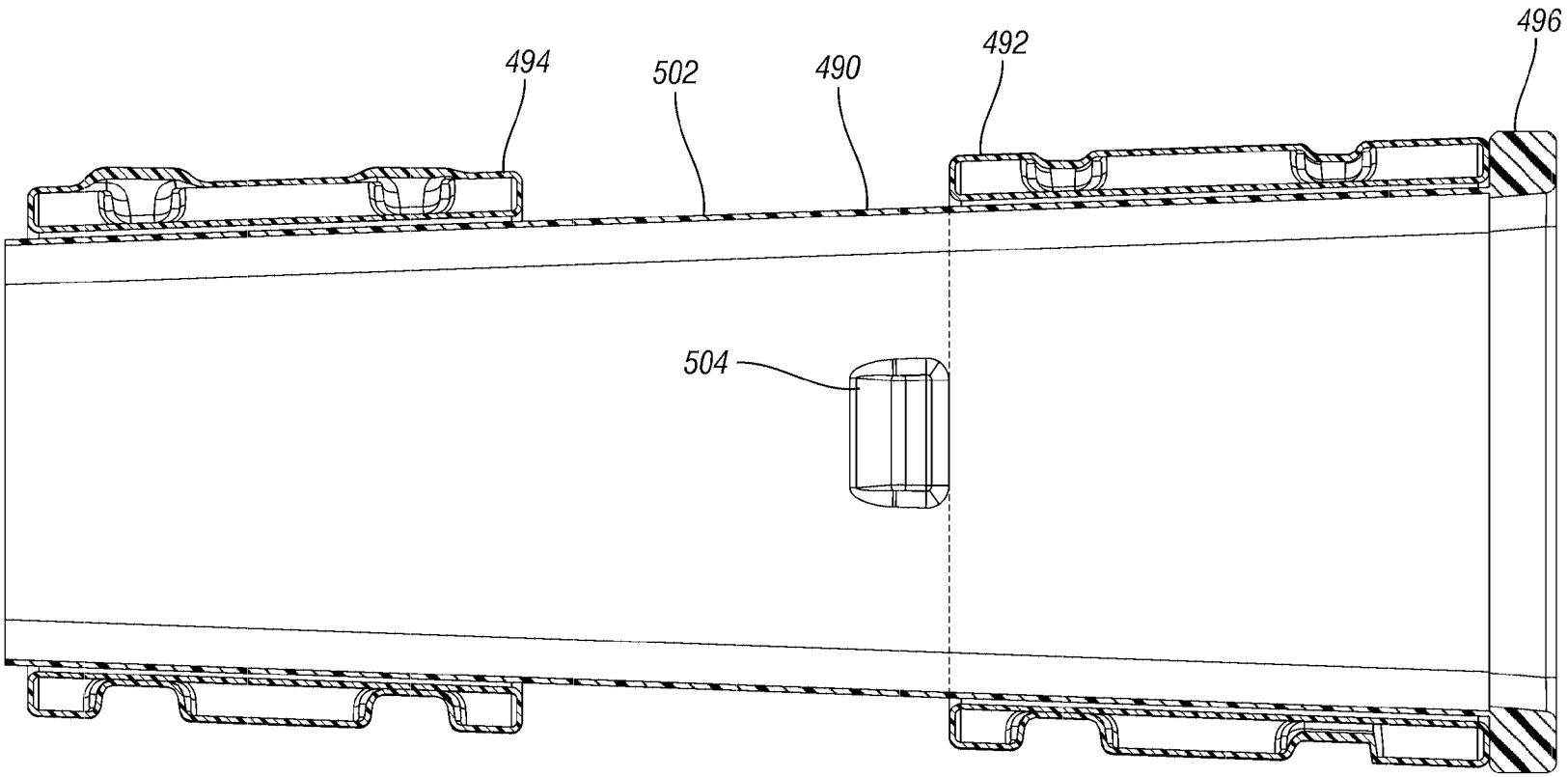
FIG. 28 is a section view through one set of supports and one sleeve of the dumpster of FIG. 17.

The sleeve 490 is shown in more detail in FIGS. 24-27. The sleeve 490 includes the front flange 496 around the periphery of the front opening of the sleeve 490. The inner flange portion 498 is larger than the remainder of the front flange 496 and includes a convex outer surface 500 protruding outwardly. The convex outer surface 500 protects the outer surface of the front wall 414 of the dumpster 410 from the fork and helps redirect the fork into the sleeve 490. The sleeve 490 further includes an elongated hollow body portion 502, which in the example shown is tapered toward the rear of the sleeve 490. At least one, and optionally several, protruding retainers 504 are integrally formed in the body portion 502 of the sleeve 490. One is shown formed in the front surface of the sleeve 490, and a second retainer 504 is formed one the rear surface of the example sleeve 490 (as can be seen in FIG. 25), but the upper and lower surfaces could also be used. The retainers 504 are sized and positioned to snap-fit past the front supports 492 to retain the sleeves 490 in the supports 492, 494, as shown in FIG. 28. Alternatively, recesses could be formed in the sleeves 490, with corresponding protrusions formed in the supports 492, 494. Additional, or alternate, fasteners (e.g. screws, rivets, etc) could also fasten the sleeves 490 to the dumpster 410.

Referring to FIG. 28, the retainers 504 and the sleeve 490 deform as the sleeve 490 is inserted through the front support 492 and then the retainers 504 snap behind the support 492 to prevent the unintended removal of the sleeve 490 forwardly from the support 492. Meanwhile, the front flange 496 and the taper of the body portion 502 prevent the sleeve 490 from sliding rearwardly in the supports 492, 494.

During use, the sleeves 490 will be subject to impact from the forks of the truck, but can be replaced by releasing the sleeve 490 by depressing the retainers 504 and sliding the sleeve 490 forwardly.

Figure 29:
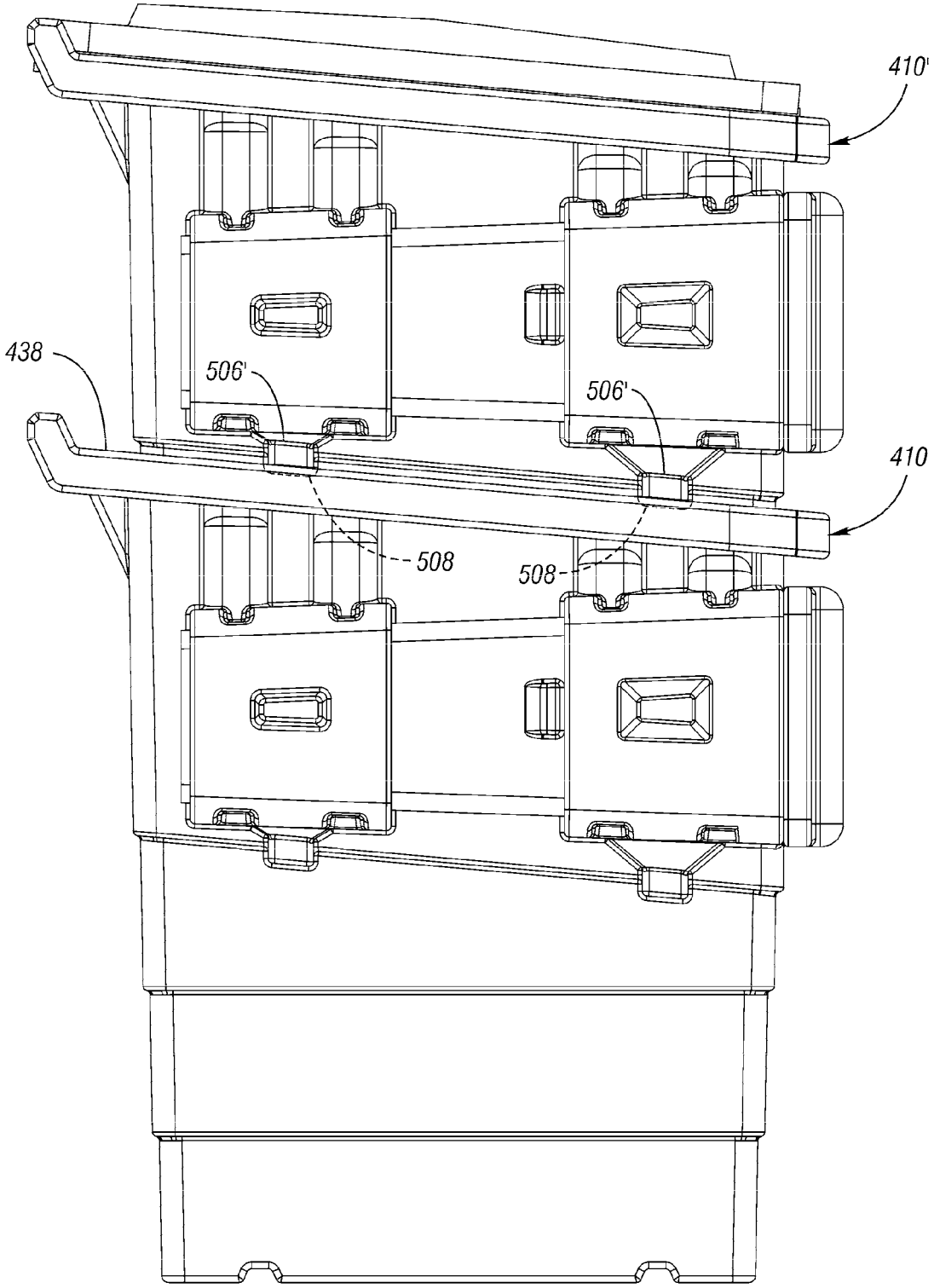
FIG. 29 is a side view of the dumpster of FIG. 17 with a similar dumpster nested therein.

FIG. 29 illustrates the dumpster 410 (without lids 440) with a similar dumpster 410' nested therein, such as for shipping or for storage. The stacking posts 506' of the upper dumpster 410' are received in the stacking recesses 508 of the lower dumpster 410 for more stable stacking and better transfer of the weight of the upper dumpster 410' to the lower dumpster 410.

The dumpsters 10, 110, 210, 310, 410 disclosed herein can be rotomolded plastic dumpsters; however, other manufacturing techniques could conceivably be used instead or in addition to rotomolding. The dumpsters 10, 110, 210 are disclosed as having integrally molded pockets, but alternatively the pockets could be formed separately and subsequently attached.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A dumpster comprising:

a base wall;

a plurality of walls extending upwardly from a periphery of the base wall to define a dumpster interior;

a lip protruding outward from at least one of the plurality of walls, the lip including a stacking recess;

a support formed on an exterior of the plurality of walls, the support integrally molded with the plurality of walls;

a stacking post below the support, the stacking post aligned below the stacking recess; and a sleeve removably secured to the support.

2. The dumpster of claim 1 wherein the sleeve has an elongated body that is tapered.

3. The dumpster of claim 1 wherein at least one of the sleeve and the support includes a retainer for securing to the other of the sleeve and the support.

4. The dumpster of claim 1 wherein the sleeve is formed of a material different from the support.

5. The dumpster of claim 1 wherein the support includes an inner wall spaced inwardly from an outer wall, the sleeve secured within the inner wall of the support.

6. The dumpster of claim 1 wherein the sleeve includes an elongated body having a flange at one end.

7. The dumpster of claim 6 wherein the elongated body of the sleeve is tapered from the one end down to an opposite end.

8. The dumpster of claim 7 wherein the flange of the sleeve includes an enlarged portion on an interior edge thereof.

9. The dumpster of claim 7 wherein the dumpster is rotomolded and wherein the support is rotomolded integrally with the plurality of walls.

10. The dumpster of claim 1 wherein the plurality of walls includes a pair of opposed side walls, the support is a front support formed on one of the side walls, the dumpster further including a rear support formed on the one of the side walls.

11. The dumpster of claim 10 further including upper gussets reinforcing the front support and the rear support and integrally molded with the dumpster.

12. The dumpster of claim 11 wherein the dumpster including the front support, the rear support and the upper gussets are rotomolded as a single, unitary structure.

13. The dumpster of claim 1 wherein the plurality of walls and the support are plastic and are molded integrally with the base wall.

14. The dumpster of claim 13 wherein the sleeve is formed of a material different from the support.

15. A method of forming a sleeve on a dumpster including the steps of:

a) releasing a snap-fit retainer securing a first sleeve to a support on at least one of a plurality of walls extending upwardly from a periphery of a base, wherein the plurality of walls are plastic and are integrally molded with the base;

b) removing the first sleeve from the dumpster;

c) inserting a replacement second sleeve into the support; and d) securing the replacement second sleeve to the dumpster.

16. The method of claim 15 wherein the replacement second sleeve has an elongated body that is tapered.

17. The method of claim 15 wherein the replacement second sleeve is formed of a material different from the support.

18. The method of claim 15 wherein the replacement second sleeve includes an elongated body having a flange at one end, said step c) further including the step of inserting the replacement second sleeve until the flange contacts the dumpster, wherein the flange overlies a portion of a front one of the plurality of walls.

19. The method of claim 18 wherein the flange includes a convex surface.

20. A method of forming a sleeve on a dumpster including the steps of:

a) inserting a sleeve into a support on at least one of a plurality of walls extending upwardly from a periphery of a base, wherein the plurality of walls are plastic and are integrally molded with the base;

b) securing the sleeve to the dumpster; and c) after said step b), releasing a snap-fit retainer and then removing the sleeve and inserting and securing a replacement sleeve in the support on the dumpster.

21. A dumpster comprising:

a base wall;

a plurality of walls extending upwardly from a periphery of the base wall to define a dumpster interior;

a support formed on an exterior of the plurality of walls, the support integrally molded with the plurality of walls; and a sleeve removably secured to the support, the sleeve including an elongated body having a flange at one end, wherein the flange of the sleeve protrudes radially outward from an entire circumference of the one end of the sleeve, the flange including an enlarged portion on an interior edge thereof, the enlarged portion protruding forwardly of a plane containing the circumference of the one end of the sleeve.

22. The dumpster of claim 21 wherein the enlarged portion includes a convex outer surface.

* * * * *